US010716374B1

(12) United States Patent
Salibi

(10) Patent No.: US 10,716,374 B1
(45) **Date of Patent: *Jul. 21, 2020**

(54) RECONFIGURABLE BAG

(71) Applicant: Rania Salibi, Tempe, AZ (US)

(72) Inventor: Rania Salibi, Tempe, AZ (US)

( * ) Notice: Subject to any disclaimer, the term of this patent is extended or adjusted under 35 U.S.C. 154(b) by 552 days.

This patent is subject to a terminal disclaimer.

(21) Appl. No.: 15/583,904

(22) Filed: May 1, 2017

Related U.S. Application Data

(63) Continuation-in-part of application No. 14/555,412, filed on Nov. 26, 2014, now Pat. No. 9,635,915.

(60) Provisional application No. 61/909,448, filed on Nov. 27, 2013.

(51) Int. Cl.

| | |
|---|---|
| ***A45C 3/06*** | (2006.01) |
| ***A45C 7/00*** | (2006.01) |
| ***A45C 13/10*** | (2006.01) |
| ***A45C 13/12*** | (2006.01) |

(52) U.S. Cl.
CPC ..... *A45C 7/0086* (2013.01); *A45C 3/06* (2013.01); *A45C 13/103* (2013.01); *A45C 13/123* (2013.01)

(58) Field of Classification Search
CPC .. A45C 7/0045; A45C 7/0086; A45C 13/1023
USPC ..... 190/903, 107; 383/16, 97
See application file for complete search history.

(56) References Cited

U.S. PATENT DOCUMENTS

| | | | | |
|---|---|---|---|---|
| 2,127,067 A | | 8/1938 | Moss | |
| 2,128,689 A | * | 8/1938 | Bingham | B65D 29/00 383/41 |
| 2,173,120 A | | 9/1939 | Lifton | |
| 2,254,578 A | | 9/1940 | O'Brien | |
| 2,479,824 A | | 8/1949 | Fass | |
| 2,502,275 A | | 3/1950 | Perlin | |
| 2,536,169 A | | 1/1951 | Gray | |
| 2,745,524 A | * | 5/1956 | Plotkin | A45C 11/02 190/115 |
| 2,875,868 A | | 3/1959 | Powell | |
| 3,061,057 A | * | 10/1962 | Miller | A45C 7/0086 190/110 |
| 3,818,962 A | | 6/1974 | Muller-Scherak | |
| 3,994,372 A | | 11/1976 | Geller et al. | |
| 4,081,061 A | * | 3/1978 | Tucker | A45C 3/00 190/108 |
| 4,257,463 A | * | 3/1981 | Monaco | A45C 3/00 150/110 |
| 4,423,834 A | * | 1/1984 | Rush | A45F 4/12 190/901 |

(Continued)

FOREIGN PATENT DOCUMENTS

| | | |
|---|---|---|
| GB | 2018580 | 10/1979 |
| JP | 2004236774 | 8/2004 |

(Continued)

*Primary Examiner* — Sue A Weaver
(74) *Attorney, Agent, or Firm* — Venjuris, P.C.

(57) ABSTRACT

Embodiments of the present invention relate to a reconfigurable bag which can form a variety of bags, handbags and purses. With all of the demands of busy lives, women today need to have a variety of bags and purses. Women need a clutch for evening use, a large purse for taking to work, a smaller purse for daytime outings, and a briefcase or computer bag. A reconfigurable bag as disclosed herein would help to eliminate these issues by providing a bag that can be converted to a variety of bags and purses.

14 Claims, 25 Drawing Sheets

(56) References Cited

U.S. PATENT DOCUMENTS

| | | | | |
|---|---|---|---|---|
| 4,723,300 | A | 2/1988 | Aranow | |
| 5,207,254 | A | 5/1993 | Fromm | |
| 5,240,106 | A | 8/1993 | Plath | |
| 5,503,204 | A | 4/1996 | Byers et al. | |
| 5,509,515 | A * | 4/1996 | Guo | A45C 7/0086 150/111 |
| 6,053,634 | A | 4/2000 | Kay | |
| 6,213,670 | B1 | 4/2001 | Wien | |
| 6,244,400 | B1 | 6/2001 | Bowers | |
| 6,296,094 | B1 | 10/2001 | Knecht | |
| 7,086,437 | B1 | 8/2006 | Michael | |
| 7,607,461 | B2 | 10/2009 | Pace | |
| 8,079,451 | B2 | 12/2011 | Rothschild | |
| 9,635,915 | B2 * | 5/2017 | Salibi | A45C 7/0086 |
| 2002/0114539 | A1 | 8/2002 | Strevey | |
| 2006/0078231 | A1 | 4/2006 | Limber | |
| 2007/0175941 | A1 | 7/2007 | Berry | |
| 2009/0028874 | A1 | 1/2009 | Van Der Burg et al. | |
| 2009/0288744 | A1 | 11/2009 | Moshirisfahini | |
| 2010/0021886 | A1 | 1/2010 | Wang et al. | |
| 2010/0127024 | A1 | 5/2010 | Cortes | |
| 2012/0255658 | A1 | 10/2012 | Andreasson | |
| 2013/0216157 | A1 * | 8/2013 | Boynton | A01K 1/0254 383/16 |
| 2013/0233661 | A1 | 9/2013 | Scott | |
| 2014/0185963 | A1 | 7/2014 | Lown | |

FOREIGN PATENT DOCUMENTS

| | | |
|---|---|---|
| JP | 2005245833 | 9/2005 |
| JP | 2006314773 | 11/2006 |
| WO | 2007/091177 | 8/2007 |

* cited by examiner

FIG. 13
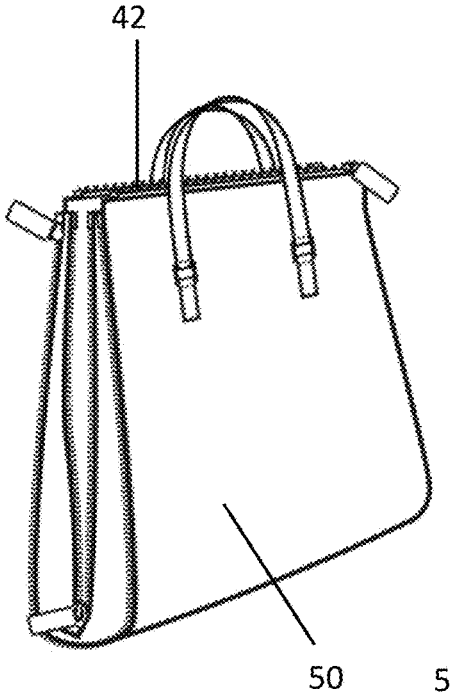
FIG. 12
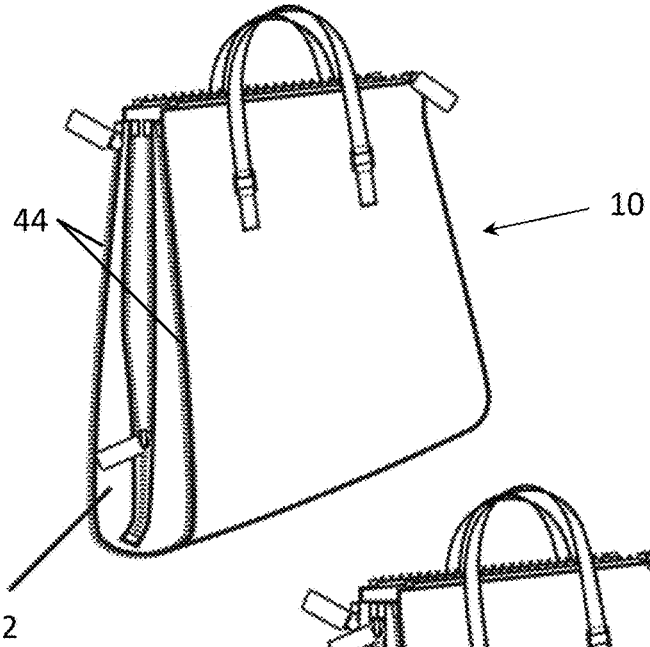
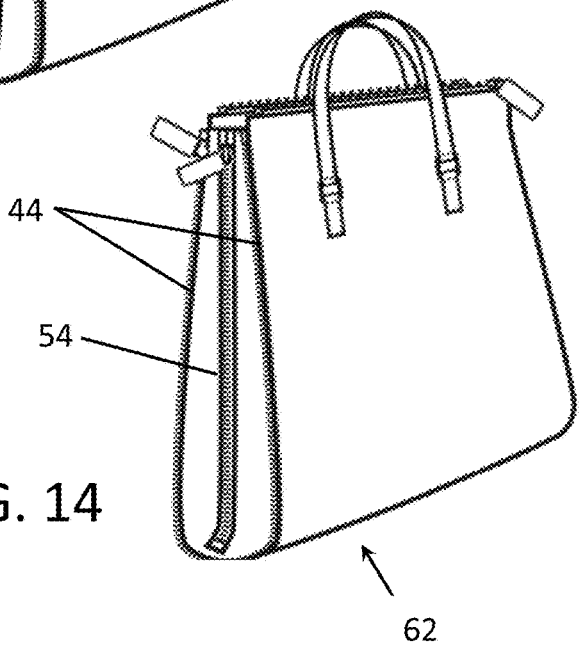
FIG. 14

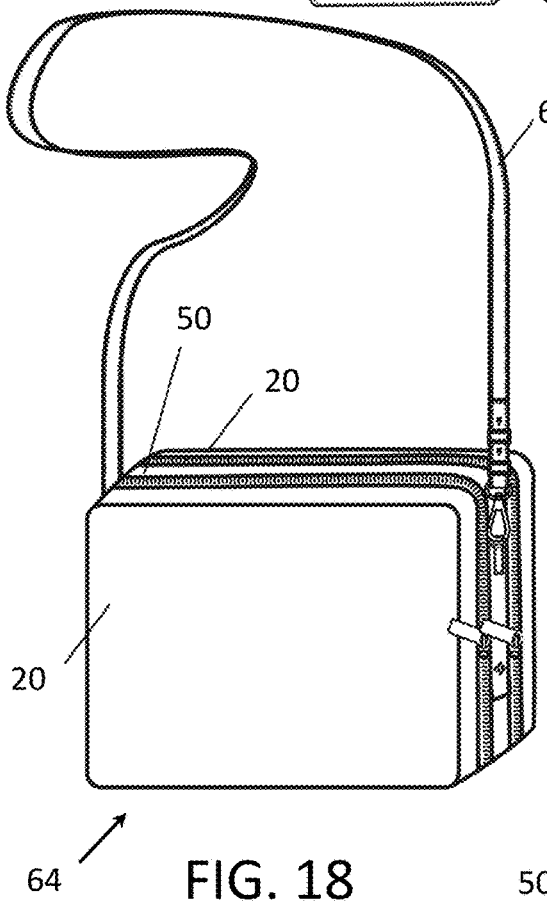
FIG. 16
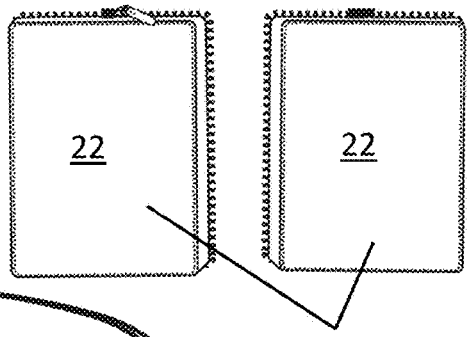
FIG. 17
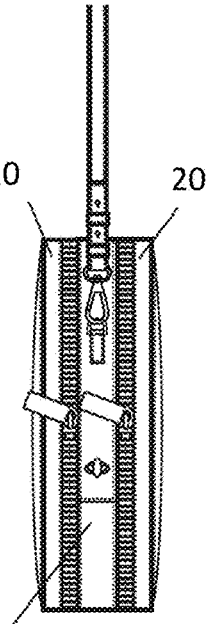
FIG. 18
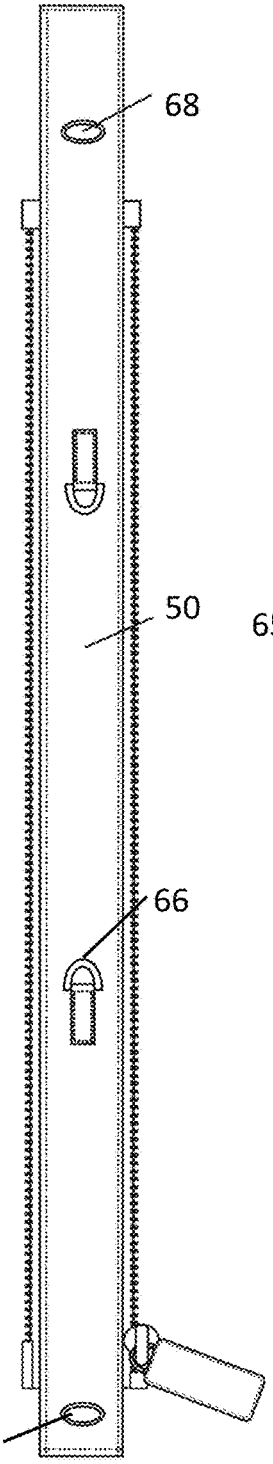
FIG. 19
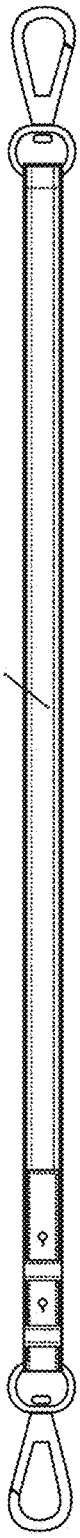
FIG. 20
FIG. 21

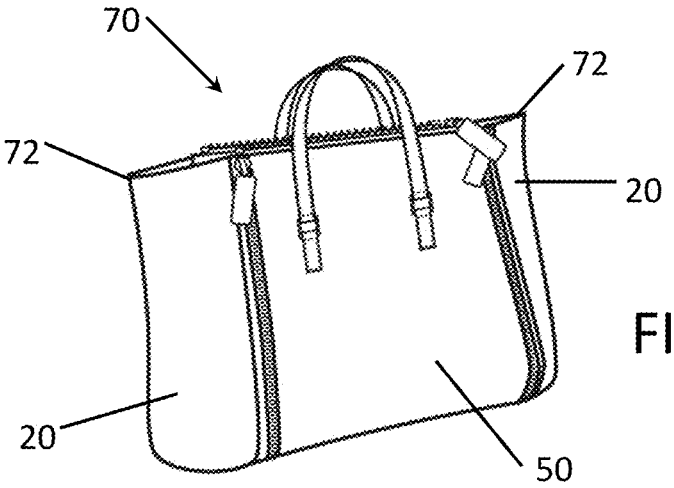
FIG. 22
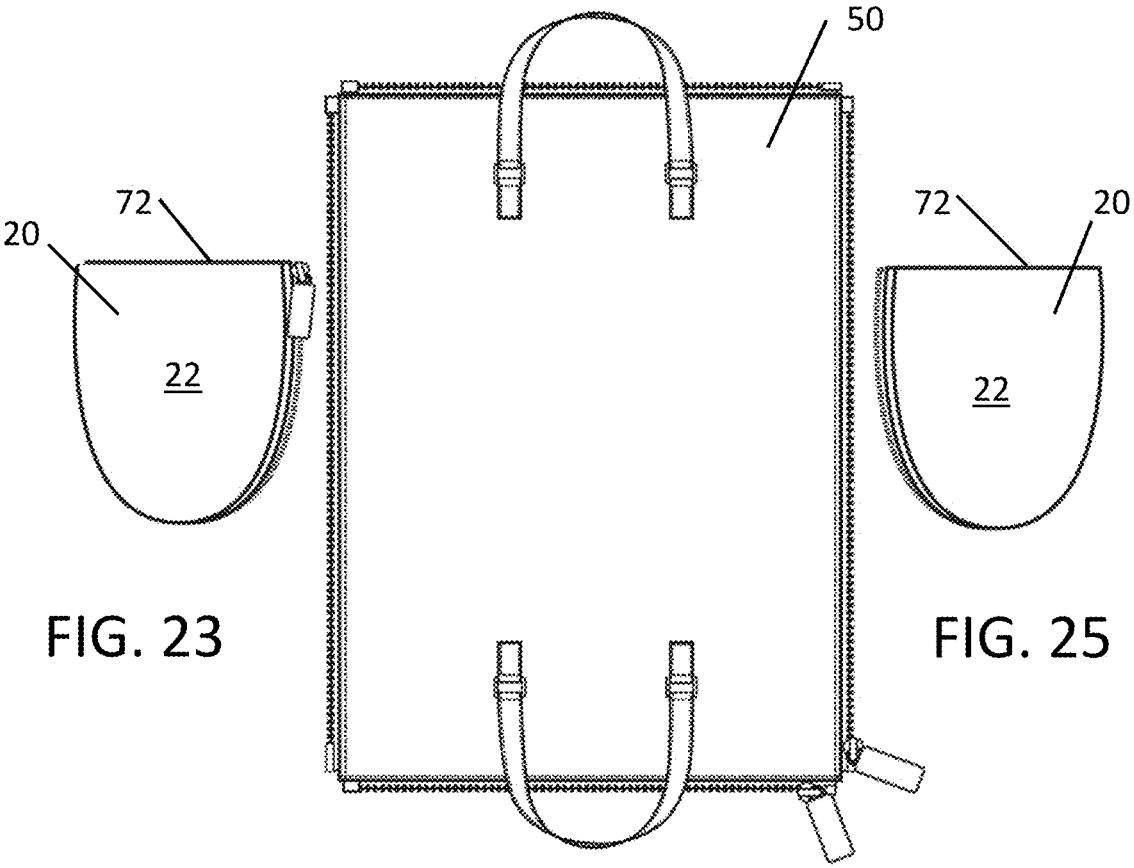
FIG. 23
FIG. 25
FIG. 24

RECONFIGURABLE BAG

CROSS-REFERENCE TO RELATED APPLICATIONS

The present application claims priority to United States patent entitled "Reconfigurable Bag" having U.S. Pat. No. 9,635,915, filed on Nov. 26, 2014, which is entirely incorporated herein by reference, and which claimed priority to United States provisional patent application entitled "Convertible Bag" having Ser. No. 61/909,448, filed on Nov. 27, 2013, which is entirely incorporated herein by reference.

BACKGROUND

This invention relates generally to a reconfigurable bag and specifically to a reconfigurable bag which can be disassembled and pieces of which can be reassembled in order to form different bags.

People today live very busy lives, often running from work to a date or other evening engagement. For women, in particular, this can cause many problems due to the fact that often a woman's work attire is not appropriate as evening attire. This problem can also be reflected in a woman's bag or purse. The purse that she carries to work may be big and have all the necessities for a day at the office, however, an evening purse such as a clutch is much smaller and contains only the essentials for a night on the town. While a woman could carry around multiple purses, this can be difficult when she is using public transportation or the like. Therefore, it is desirable for a woman to have a purse or bag that can easily convert from a daytime bag to an evening clutch.

People today also have a need for many different types of bags or purses. For instance, a woman may own a large purse for everyday use, a smaller purse for daytime activities that do not require as large a purse, a computer bag or briefcase and the evening bag or clutch discussed in the previous paragraph. People in general and women in particular invest a lot of money in bags and purses in order to have the right bag for the occasion. Women also devote a large amount of storage space in their homes to the storage of the many bags and purses that they require. It would, therefore, be desirable to have a bag or a purse that could be converted from a large daytime purse to a smaller purse, computer bag or clutch and then easily converted back to the large daytime purse or to any of the other types of bags or purses.

In the prior art, there are examples of convertible purses. For instance, there are several patents such as U.S. Pat. No. 5,207,254, issued to Fromm, which describe a base purse or liner which is slipped inside various purse covers in order to obtain different looks. Patents like U.S. Pat. No. 5,503,204, issued to Byers et al., describe purses which have interchangeable closure flaps in order to give the purse different looks for different occasions. U.S. Publication No. 2009/0288744, filed by Moshieisfahini et al., and U.S. Pat. No. 3,994,372, issued to Geller et al., describe purses that have detachable side panels. Once the side panels are detached, the purse body is simply a rectangle of material. The purse can then be packed flat in a suitcase or such. U.S. Publication No. 2010/0218862, filed by Ellermeyer, describes a purse having a bottom portion that can be removed and then the bottom of the purse can be used as a clutch. The prior art does not, however, describe a purse that can be converted from a daytime purse to a computer bag, smaller purse or clutch and then easily be converted again to any of the other forms.

Accordingly, what is needed is a reconfigurable bag or purse which can be converted to a variety of other types of bags or purses and then easily converted back to the original form or to any of the other types of bags or purses.

DISCLOSURE OF THE INVENTION

The invention, as disclosed hereafter in this application, is a reconfigurable bag (or handbag). People in general and women in particular need many different types of purses or bags in their daily lives. The reconfigurable bag of the present invention is formed of a plurality of bag pieces which can be coupled together to form a variety of types and sizes of bags or purses.

In the preferred embodiment, a reconfigurable bag comprises a plurality of bag pieces coupled to a plurality of connectors. Coupling at least one of the plurality of bag pieces with at least one of the plurality of connectors forms a bag and coupling different quantities and types of bag pieces forms different types or sizes of bags. In alternate embodiments, a reconfigurable bag comprises combinations of different shaped end pieces, different sized center pieces, interior pockets, handles, and straps.

A method for converting a reconfigurable bag comprises uncoupling a plurality of bag pieces which form a bag; and recoupling at least one of the plurality of bag pieces to form a different type or shape of bag.

The foregoing and other features and advantages of the reconfigurable bag will be apparent to those of ordinary skill in the art from the following more particular description of the invention and the accompanying photos.

BRIEF DESCRIPTION OF THE DRAWINGS

FIG. 12 is a perspective view of a center piece embodiment with the first set of matable extension flap edges in the unmated state.

FIG. 13 is a perspective view of a center piece embodiment with the first set of matable extension flap edges in a partially mated state.

FIG. 14 is a perspective view of a center piece embodiment with the first set of matable extension flap edges in a mated state.

FIG. 16 is a perspective view of an end piece embodiment.

FIG. 17 is a perspective view of another end piece embodiment, forming a pair with the end piece of FIG. 16.

FIG. 18 is a perspective view of a cross-body bag formed by a pair of end pieces and a center piece.

FIG. 19 is a side view of a cross-body bag.

FIG. 20 is a top view of a center piece of cross-body bag embodiment laid flat, the center piece having connector for a cross-body strap.

FIG. 21 is a top view of a cross-body strap.

FIG. 22 is a perspective view of a tote-bag embodiment.

FIG. 23 is a perspective view of an unmated end piece 20 for a tote bag embodiment.

FIG. 24 is a top view of a center piece 50 embodiment laid flat, illustrating a pair of male/female matable edges with the unmated end pieces 20 of FIG. 23 and FIG. 25.

FIG. 25 is a perspective view of an unmated end piece 20 for a tote bag embodiment.

FIGS. 58 and 59 illustrate an alternate embodiment of a center piece 50 with a non-separating zipper 80 at the top. FIG. 59 also shows a ring 88 for removably interlocking with the end of the non-separating zipper.

DESCRIPTION OF THE EMBODIMENTS

Figure 1:
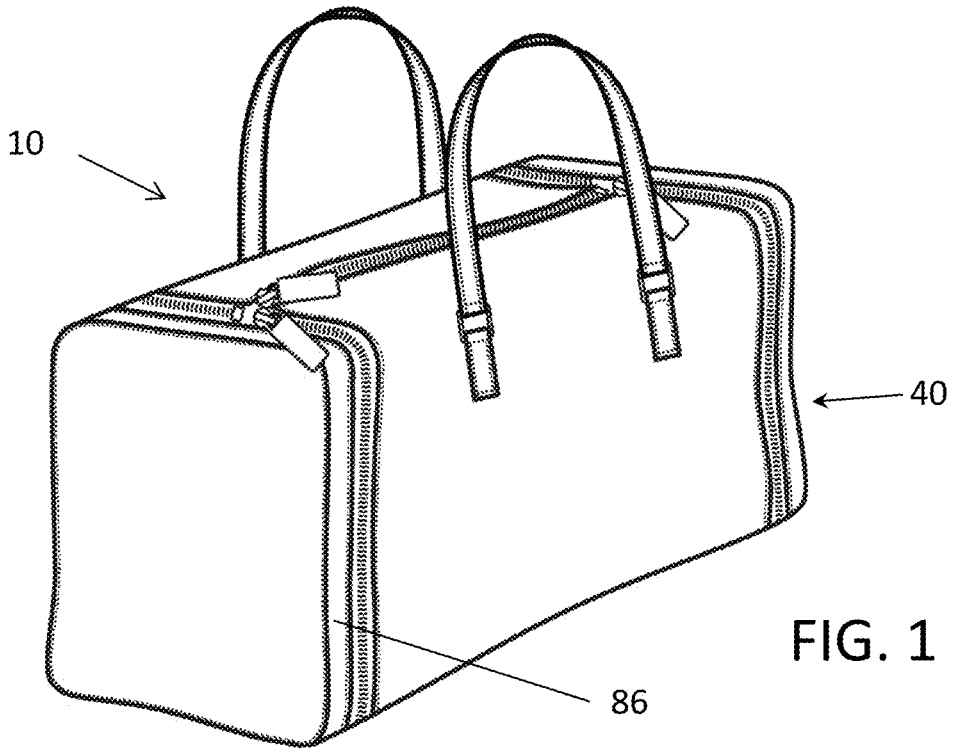
FIG. 1 is a perspective view of a reconfigurable bag embodiment.
Figure 2:
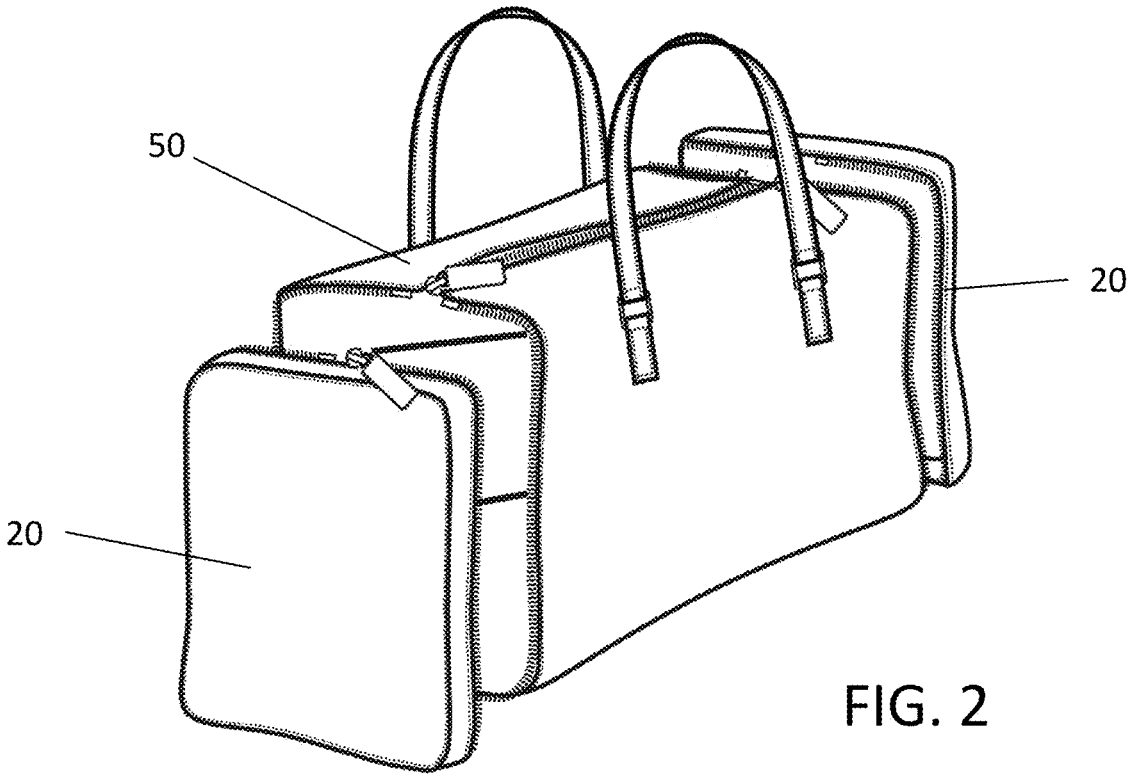
FIG. 2 is a perspective view of the reconfigurable bag of FIG. 1 with the end pieces removed.
Figure 3:
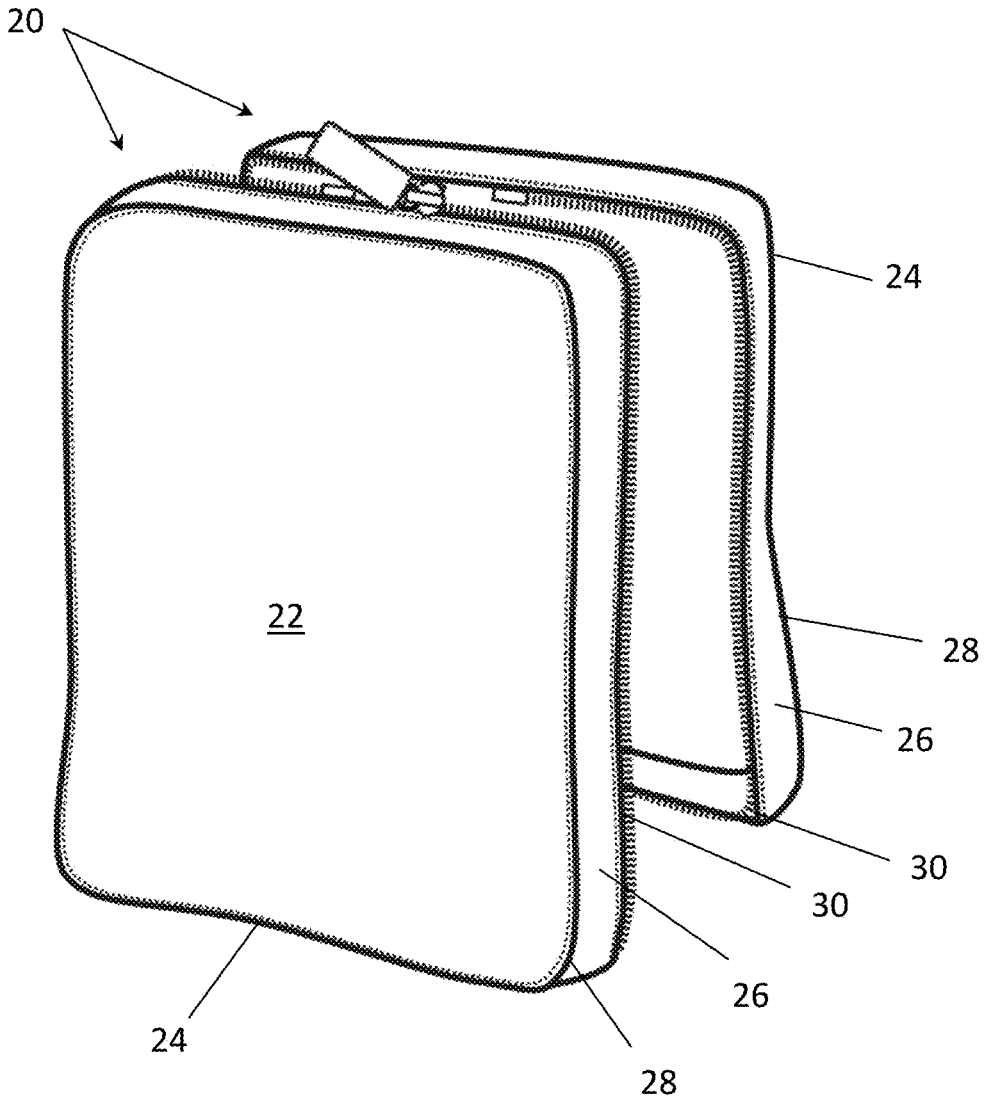
FIG. 3 is a perspective view of a pair of end pieces.

As discussed above, embodiments of the present invention relate to a reconfigurable bag which can form a variety of bags, handbags and purses. With all of the demands of busy lives, women today need to have a variety of bags and purses. Women need a clutch for evening use, a large purse for taking to work, a smaller purse for daytime outings, and a briefcase or computer bag. Likewise when traveling, the need to pack multiple bags for different occasions is minimized with a reconfigurable bag. A reconfigurable bag as disclosed herein would help to eliminate these issues by providing a bag that can be converted to a variety of bags and purses.

Reconfigurable Handbag/Clutch Embodiment

FIGS. 1-13 illustrate the preferred embodiment of a reconfigurable bag 10. The reconfigurable bag 10 is formed from multiple bag pieces. These bag pieces are sections or components of a larger bag which can be separated from each other and reconfigured in to other bags. For example, these bag pieces are coupled together in order to form the reconfigurable bag 10 shown in FIG. 1. Alternatively, the bag pieces can be coupled together in different ways to form a variety of types and sizes of bags as shown in the balance of the drawings.

Turning now to FIGS. 1-6, the preferred reconfigurable bag 10 has a pair of end pieces 20 and a center piece 50. Each end piece 20 comprises an end face 22 having an outer perimeter 24 and an extension wall 26 connected to the outer perimeter 24 at a first end piece edge 28. The extension wall 26 extends in a different plane than the end face 22 to provide depth to the end piece, which is important to form a first handbag 40. (See FIG. 1.) In addition, the extension wall 26 has been found to be important to add strength and stiffness to the end pieces 20 and, in turn, the second bag 60. (See FIG. 6.)

Figure 57:
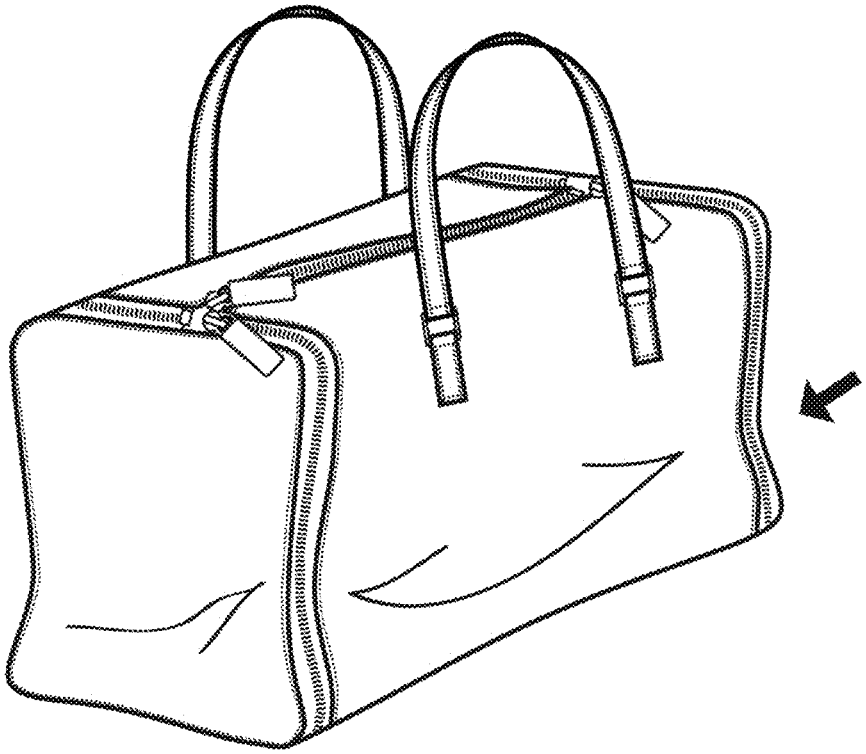
FIG. 57 illustrates a perspective view of a bag not having extension wall 26 and with zipper tape connected directly to end face 22.

For example, extension wall 26 creates support for the first (or larger) bag 40. (See, FIG. 1.) If the end pieces 20 did not have extension wall 26 (see FIG. 57) then the first end piece edge 28 and the second end piece matable edge 30 would be the same edge, making the end piece 20 a flat disk (or "pancake"). If a zipper were sewn directly to the end piece with no extension wall 26, there is less support at the seam. When a zipper tape is connected directly to end face 22, the bag collapses easier than with extension wall 26. Without extension wall 26, the first handbag 10 has less structural support and the end pieces 20 and the center piece 50 would bend significantly. (See, FIG. 57.) Also, if a zipper is located at the seam, functionally it would not be as easy to disconnect end pieces 20 from the center piece 50.

Figure 4:
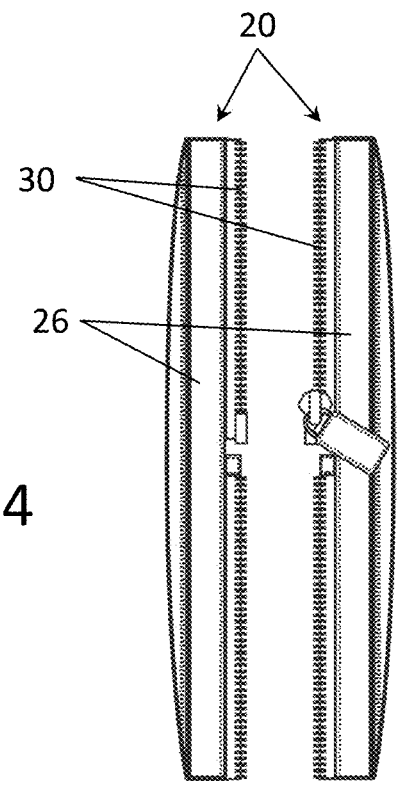
FIG. 4 is a side view of an unmated pair of end pieces.
Figure 5:
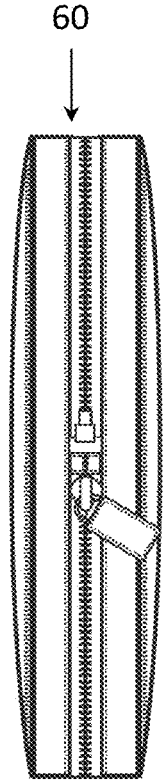
FIG. 5 is a side view of a mated pair of end pieces.
Figure 6:
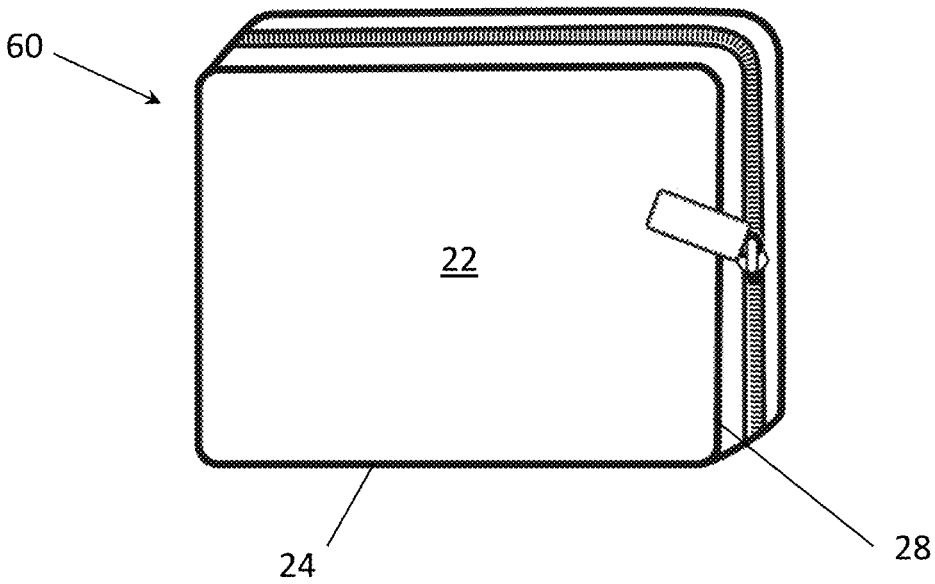
FIG. 6 is a perspective view of a mated pair of end pieces.
Figure 7:
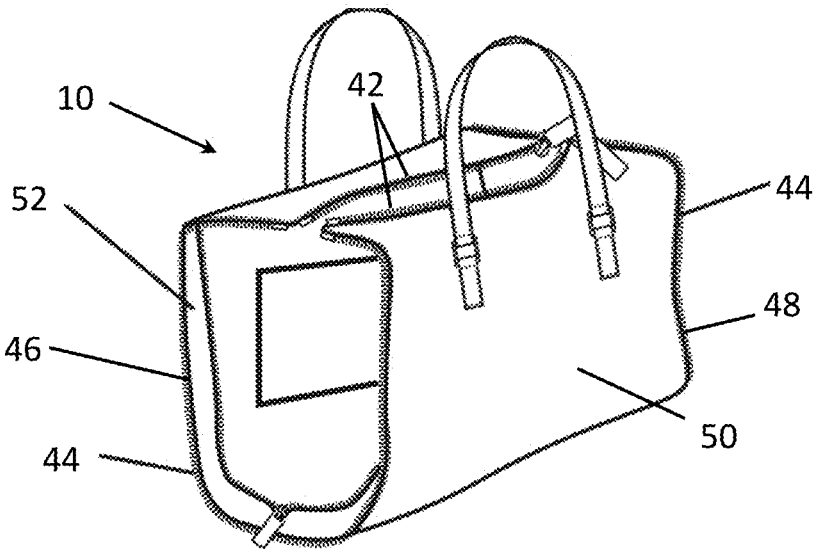
FIG. 7 is a perspective view of an unmated center piece embodiment.
Figure 8:
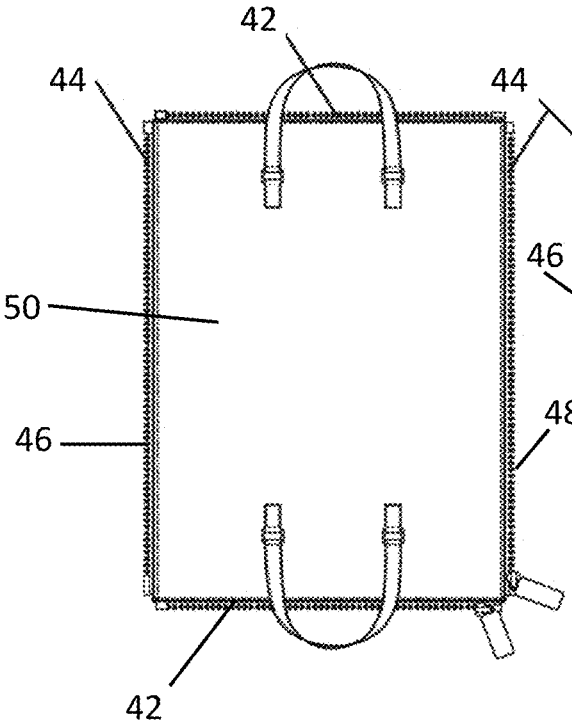
FIG. 8 is a bottom view of the unmated center piece of FIG. 7 laid flat.
Figure 9:
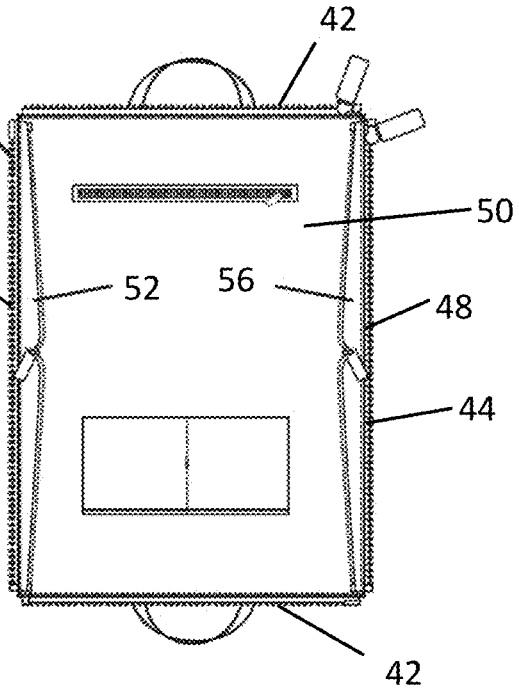
FIG. 9 is a top view of the unmated center piece of FIG. 7 laid flat.

A first handbag 40 is formed by mating the center piece 50 between the end pieces 20 along the second end piece edge 30 of each extension wall 26 as shown in FIG. 1. A second handbag 60 is formed by mating the pair of end pieces 20 along a second end piece edge 30 of each extension wall 26 as shown in FIGS. 4-6.

A first pair of matable edges 42 creates a closable opening to the bag 10. For example, in both the reconfigurable bag 10 embodiments shown in FIG. 1 and FIG. 13, the first pair of matable edges 42 is created by a separating zipper that extends the full width of centerpiece 50. The zipper allows the purse to be closed to prevent items from falling out.

The various pieces of the reconfigurable bag 10 are preferably mated to each other by conventional separating zippers, but those in the art will recognize many ways the two pieces could mate, including snaps, hook and loop fasteners and other matable fasteners known in the art.

Figure 15:
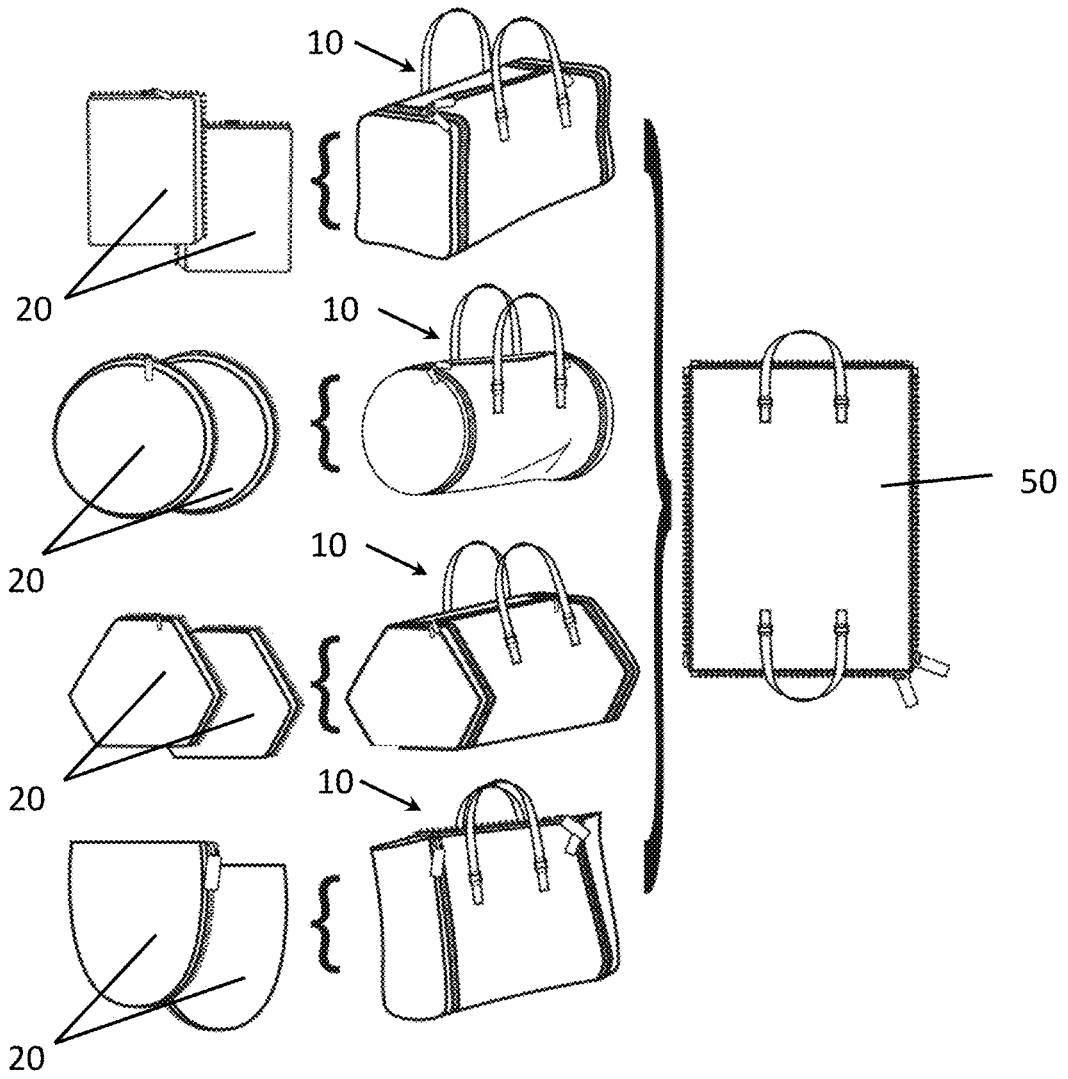
FIG. 15 illustrates a plurality of end piece embodiments that can be mated with a single center piece embodiment to form a plurality of bag shapes.

As long as the length of the end piece edges 28, 30 matches the length of the second pair of matable edges 44, then the end pieces 20 can take any desired shape. As shown in FIG. 15, the end pieces 20 may be rounded squares as illustrated in the figures, circles, triangles, concave or any other shape desired. The end pieces 20 may lay flat when uncoupled from the reconfigurable bag 10 or they may be concave, have pleats or the like. The end pieces 20 may be any color, pattern, texture, sheen or the like. The end pieces 20 may be formed from any material desirable. They may be pliable or rigid. The end pieces 20 may also be reversible if desired. The end pieces 20 may also have pockets, loops, hooks or other accessories such as handles removably or permanently coupled to them.

The end pieces 20 can be coupled to the center piece 50, as seen in FIG. 1. The center piece 50 in the embodiment illustrated in the figures is rectangular (see FIG. 10). The center piece 50 may be any shape desired, however. When mated with the end pieces 20, the cross-sectional shape of the center piece 50 will be determined by the shape of the end pieces 20.

The center piece 50 may be a rectangle, square, triangle, circle, diamond or the like. The at least center piece 50 may be formed from a pliable or rigid material. The center piece 50 may be any color, pattern, texture, sheen or the like. The center piece 50 may lay flat when disconnected from the other bag sections or it may have pleats or hold a permanent shape. The center piece 50 may also comprise stiffeners. The center piece 50 may also be reversible if desired. The center piece 50 may also have pockets, loops, hooks or other accessories removably or permanently coupled to it.

Figure 58:
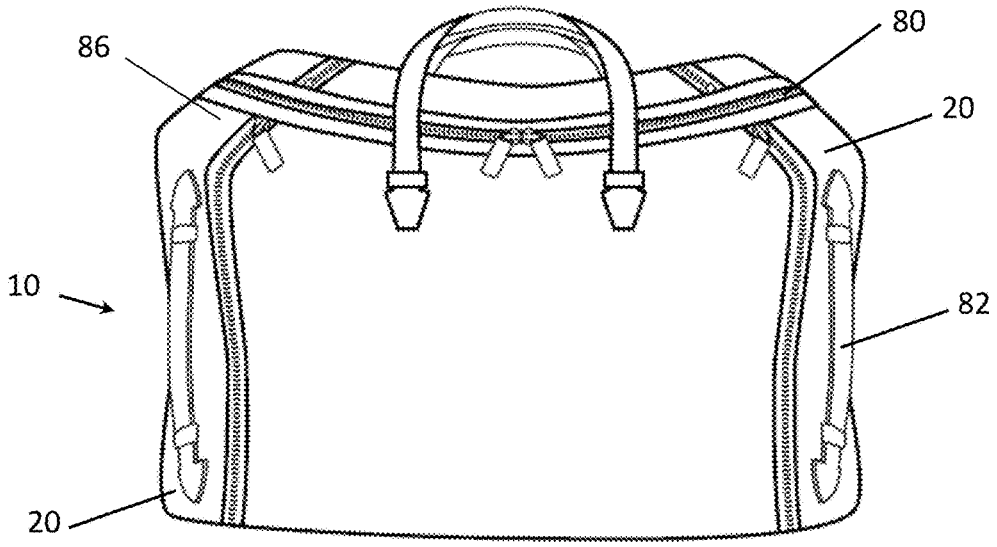
FIGS. 58 and 59 illustrate an alternate embodiment of the bag shown in FIG. 1. This embodiment has handles 82 strategically placed on the end pieces 20 so that they act as handle straps for the handbag/clutch embodiment shown in FIG. 62. In addition.
Figure 59:
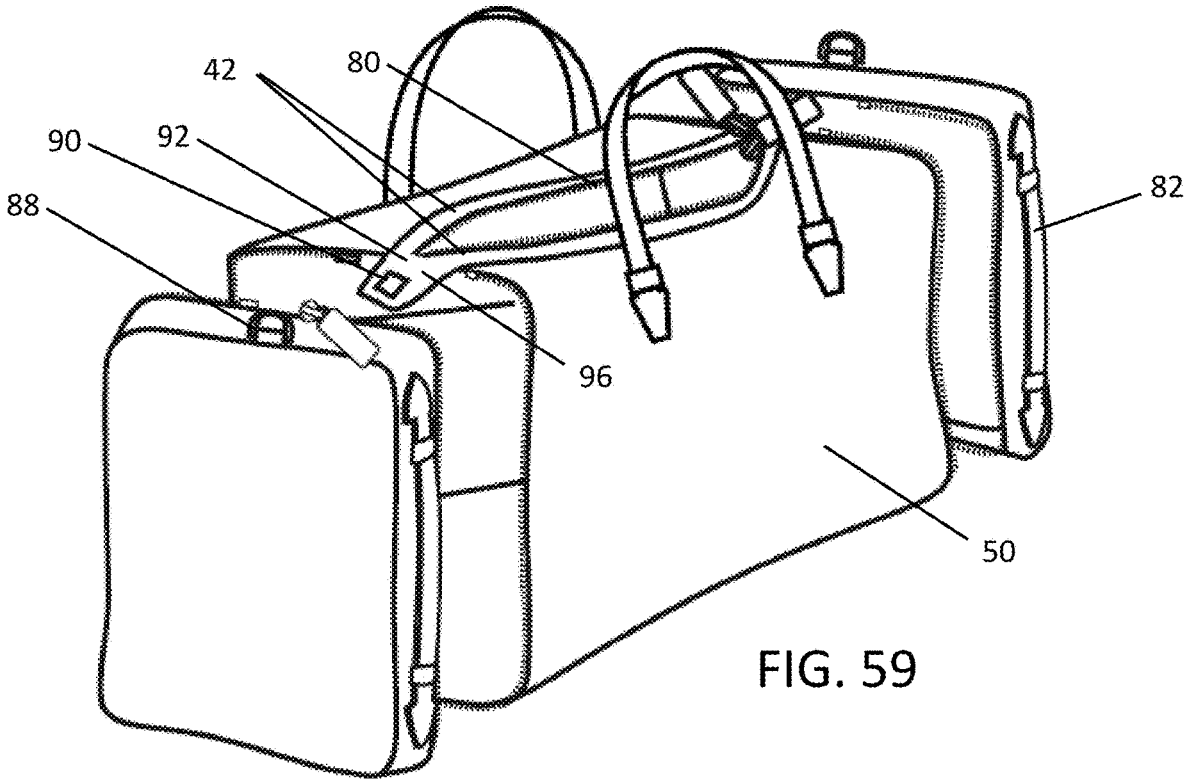
Figure 60:
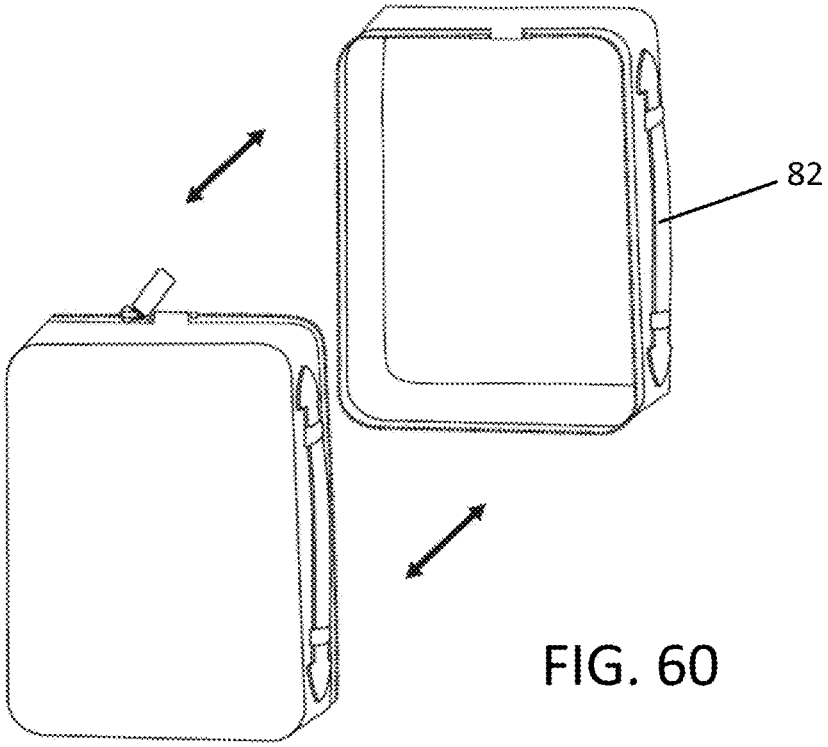
FIGS. 60-62 are analogous embodiments of the handbag/clutch embodiments shown in FIGS. 3-6 with the addition of the handles 82 shown in FIGS. 58-59. While the drawings show a pair of handles, those in the art will recognize that the hand bag functions adequately with only one handle (not shown) or no handles as shown in FIG. 6.

Additional alternative embodiments are shown in FIGS. 58-65. For example, FIG. 58 illustrates an alternate embodiment of the bag shown in FIG. 1. This embodiment has handles 82 strategically placed on the end pieces 20 so that they act as handle straps for the handbag/clutch embodiment shown in FIG. 62. In addition, FIGS. 59 and 60 illustrate an alternate embodiment of a center piece 50 with a non-separating zipper 80 at the top. FIG. 59 also shows a ring 88 for removably interlocking with the end of the non-separating zipper.

Figure 61:
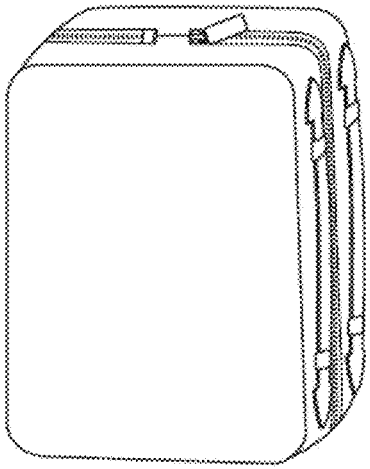
Figure 62:
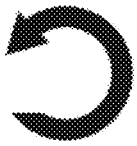
Figure 62:
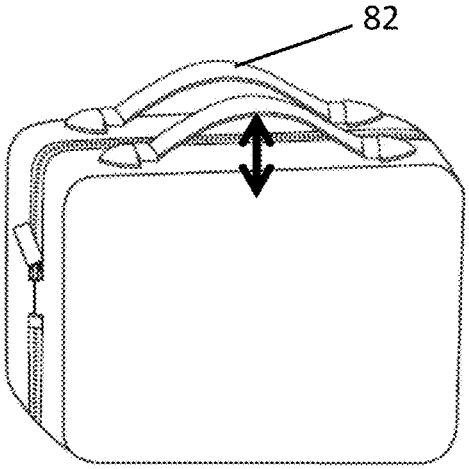

FIGS. 60-62 are analogous embodiments of the handbag/clutch embodiments shown in FIGS. 3-6 with the addition of the handles 82 shown in FIGS. 58-59.

Figure 63:
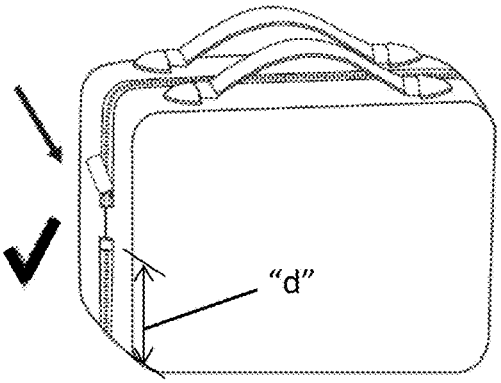
FIGS. 63 and 64 contrast the importance of locating the end of the clutch zipper 84 at a distance d above the bottom corner so that the clutch can be opened from the top.
Figure 64:
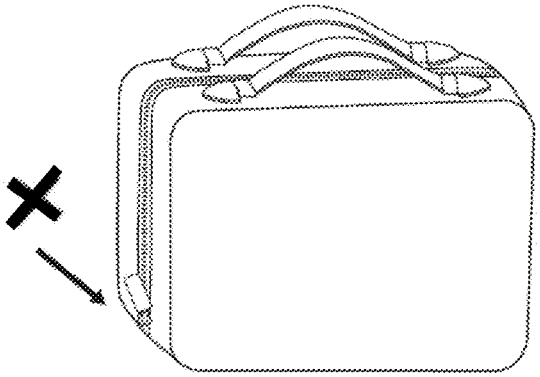

FIGS. 63 and 64 illustrate the importance of locating the end of the clutch zipper 84 at a distance d above the bottom corner so that the clutch can be opened from the top.

Figure 65:
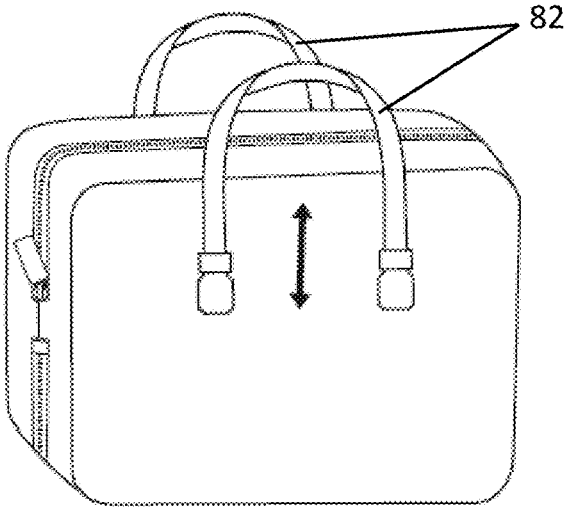
FIG. 65 illustrates an alternate embodiment of handles 82 as compared to the handles shown in FIG. 58.
Figure 66:
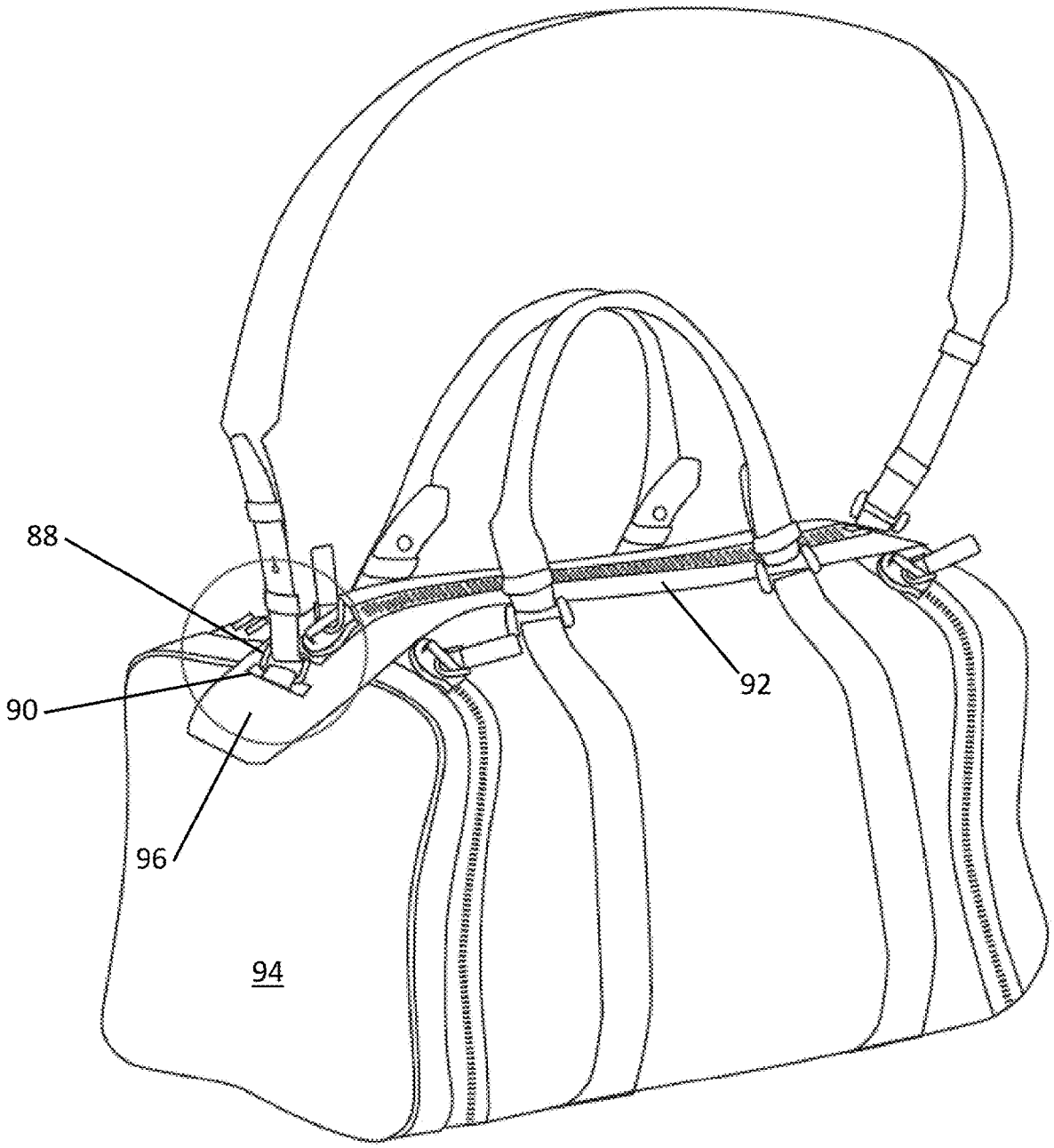
FIGS. 66 and 67 illustrate how the ring 88 that is connected to the end panel can push through the opening 90 in the frame 92 to removably interlock the frame 92 and the ring 88.
Figure 67:
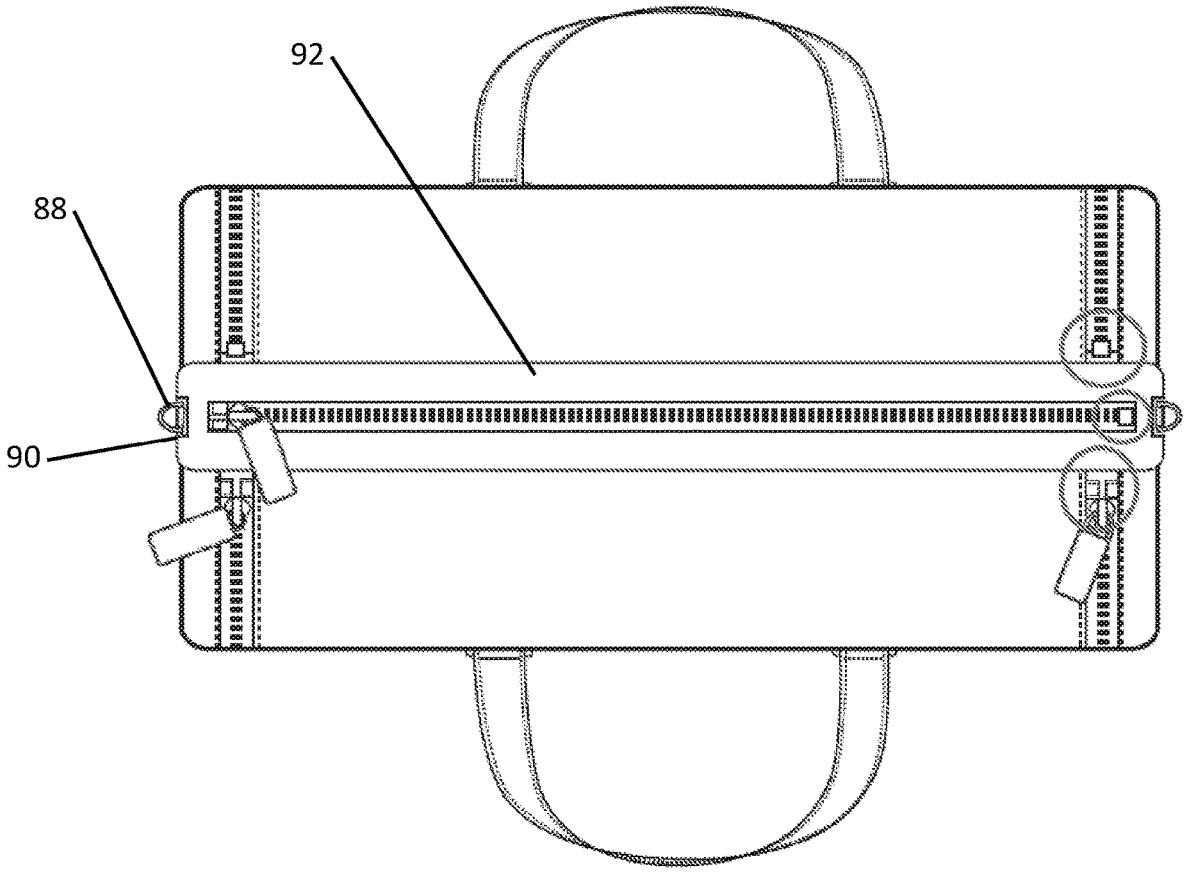

FIG. 65 illustrates an alternate embodiment of handles 82 as compared to the handles shown in FIG. 58. The handles shown are known as trunk handles, but those in the art will recognize that many types of handles would be suitable here.

The various embodiments illustrate how the reconfigurable bag 10 can be at least a "3 in 1" bag concept: a midsize duffle/purse, a clutch and/or side bag, and a tote. This enables the reconfigurable bag to be more than just an expandable bag but rather an interchangeable bag that evolves into different purpose bags.

The end pieces 20 preferably have a gusset structure 86 that attaches one panel to the zipper and move the zipper away from the end panel. This is important because when the end pieces 20 join together, the bag is able to be hand-held and the bag can stand-alone in the upright position like any other handbag because the gusset structures 86 move the end panels away from each other. In this way, the end pieces can function on their own as a handbag when joined together. The zipper and handle are strategically positioned so that when the end pieces mate, they evolve into other designs. When these pieces have joined, the clutch-like/bag is then rotated so the handles are conveniently located in the upright position. These end pieces 10 are designed to evolve and attach to multiple attachments not just a center extension piece.

As contrasted by FIGS. 63 and 64, it is preferred that the start/opening of the zippers on end pieces 10 be placed in the center of the panel, so that when the clutch-like/bag is opened, the contents do not fall out. This allows for the end pieces 10 to function like a handbag/clutch. The handles 82 are also preferably placed so that when the end piece rotates, they can function alone, with a center piece, an extension piece or the like.

If the zipper starts/ends at the bottom as shown in FIG. 64, the items in the bag can spill out. Placing the start/end at a distance "d" above the bottom serves the purpose of securing the contents in the bag from falling out. While the starting the zipper at the approximate midpoint between the top and bottom of the panel is most preferred, starting at least above the bottom and more preferably at least one quarter of the distance between the top and bottom of the end panel will provide a benefit as compared to starting/stopping the zipper at the bottom. Likewise, when one piece (panel) is removed from the clutch shown in FIG. 63, the user can zip up the exposed space right away, rotate the bag to the side where another panel may be removed and repeat.

Interlocking Method that Attaches End Pieces to Center Piece

FIGS. 58, 59, 66 and 67 illustrate how a ring 88 can be connected to the end piece 20 and then removably interlock with the non-separating zipper frame 92. For example, as shown in the drawings, a frame 92 can be attached to the center piece 50 so that the frame 92 surrounds the main opening of the bag, with end flaps 96 not being connected to the center piece 50. A zipper can be sewn into the frame 92 to create a non-separating zipper 80. The frame 92 connects the center piece 50 to the end pieces 20 by an interlocking method via end flaps 96, opening 90 and a ring 88. The ring 88 is connected to the end piece 20. Opening 90, which is a hole in end flap 96, slides over the ring 88. Once the ring 88 is through the opening 90, a cross-body strap (or other strap) can be connected to the ring 88 to interlock the frame 92 with the ring 88.

Those in the art will recognize that the ring 88 can be a ring, a d-ring, or any other ring-like mechanism that can connect to the end piece 20. Likewise, the frame is preferably made from leather, but most any flexible fabric will suffice. Because the frame 92 is attached to the center piece 50, the interlocking connection creates a direct connection to the end pieces 20. In addition, the end flaps 96 are helpful for the user to hold when operating the non-separating zipper.

Reconfigurable Center Piece/Laptop Bag Embodiment

In another embodiment, the center piece 50 can be reconfigured into a third bag, such as the laptop bag 62. Turning now to FIGS. 7-14, the preferred embodiment of center piece 50 is quadrilateral-shaped, comprising a first pair of matable edges 42 located on opposite sides of the center piece 50. The first pair of matable edges 42 is configured to mate with each other. A second pair of matable edges 44 is located on opposite sides of the center piece 50. A first center piece edge 46 of the second pair of matable edges 44 is configured to mate with a first end piece 20 and a second center piece edge 48 of the second pair is configured to mate with a second end piece 20.

A first extension flap 52 is connected to the center piece 50 and oriented parallel to the first center piece edge 46 of the second pair of matable edges 44. The first extension flap 52 is bifurcated along an axis A-A parallel to the first pair of matable edges 42 to form a first set of matable extension flap edges 54. The first set of matable extension flap edges 54 are configured to mate with each other.

A second extension flap 56 is connected to the center piece 50 and oriented parallel to the second center piece edge 48 of the second pair of matable edges 44. The second extension flap 56 is also bifurcated along an axis parallel to the first pair of matable edges 42 to form a second set of matable extension flap edges 58. The second set of extension flap edges 58 are configured to mate with each other.

Figure 10:
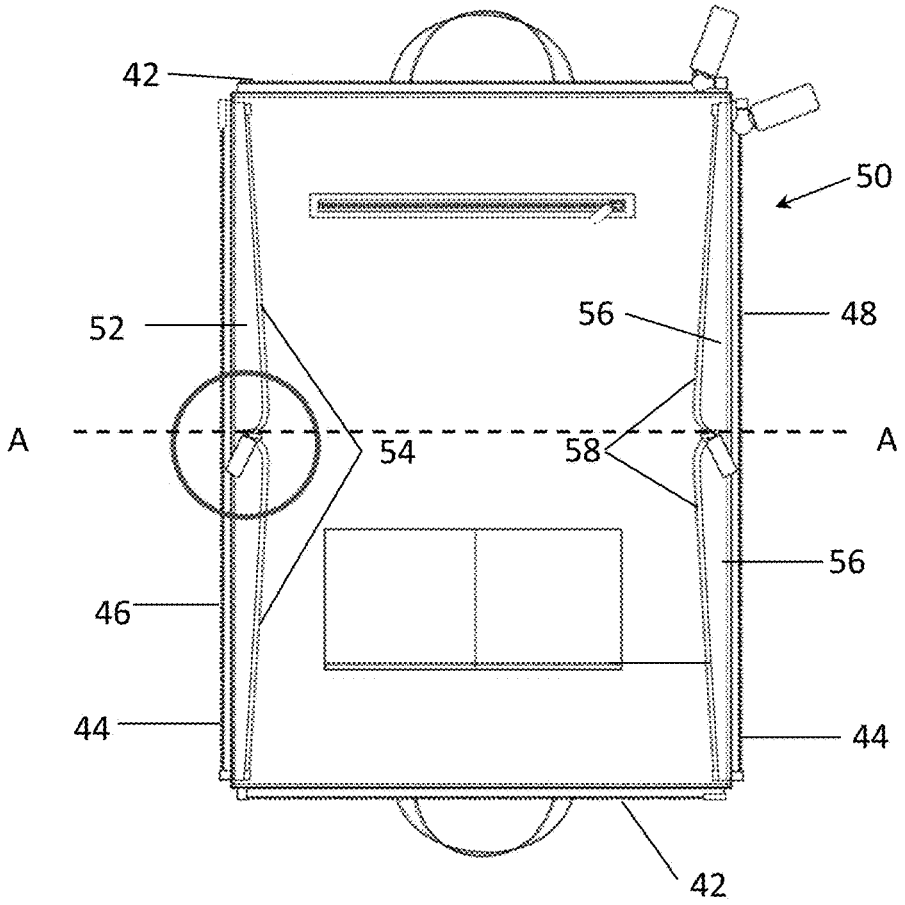
FIG. 10 is a top view of the unmated center piece of FIG. 7 laid flat showing the location of the enlarged view of FIG. 11.
Figure 11:
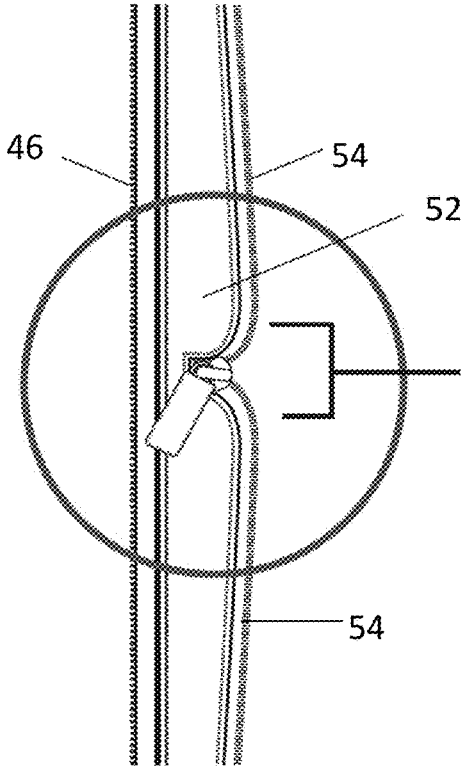
FIG. 11 is a partial view of FIG. 10 enlarged for magnification purposes.

As shown in FIGS. 10-11, the preferred extension flap (52, 56) is relatively narrow near the first pair of matable edges 42 and gradually gets wider toward the middle. In the middle, the extension flap edges (54, 58) for a rounded (or curved) "v" shape, which enables the center piece 50 to fold and zip much easier than without a rounded "v" shape. In addition, the rounded "v" shape allows the center piece 50 to lie flat when the extension flap edges 54, 58 are in the unmated position.

The extension flap edges 54, 58 have two purposes: (1) to act as a bag lining so that when end pieces 20 are being removed from the center piece 50 the items in the bag do not fall out, and (2) to create a laptop style look by allowing the center piece 50 to be folded in half and zipped. This allows the center piece to be a standalone piece and to turn into its own bag. A step by step process is discussed in more detail in a later section.

Reconfigurable Cross-Body Bag Embodiment

As shown in FIGS. 16-21 another embodiment of the reconfigurable bag 10 results in what is commonly referred to in the art as a cross-body bag 64. A cross-body bag 64 can be formed by employing a narrow center piece 50 mated between a pair of end pieces 20. A cross-body strap 65 can be employed by connecting a D-ring or similar connector 66 to the center piece 50 as shown in FIG. 19. A turn-lock, snap or other similar matable closing piece 68 can be employed at the ends of the center piece 50 as shown in FIG. 19.

Reconfigurable Tote Bag Embodiment

Another embodiment is the tote bag 70 shown in FIG. 22. The end pieces 20 have a top edge 72 that is open (i.e., not matable with center piece 50) as shown in FIGS. 23 and 25. This configuration allows the reconfigurable bag 10 to form an open top tote bag 70.

Tube Style Center Piece Embodiment

Figure 26:
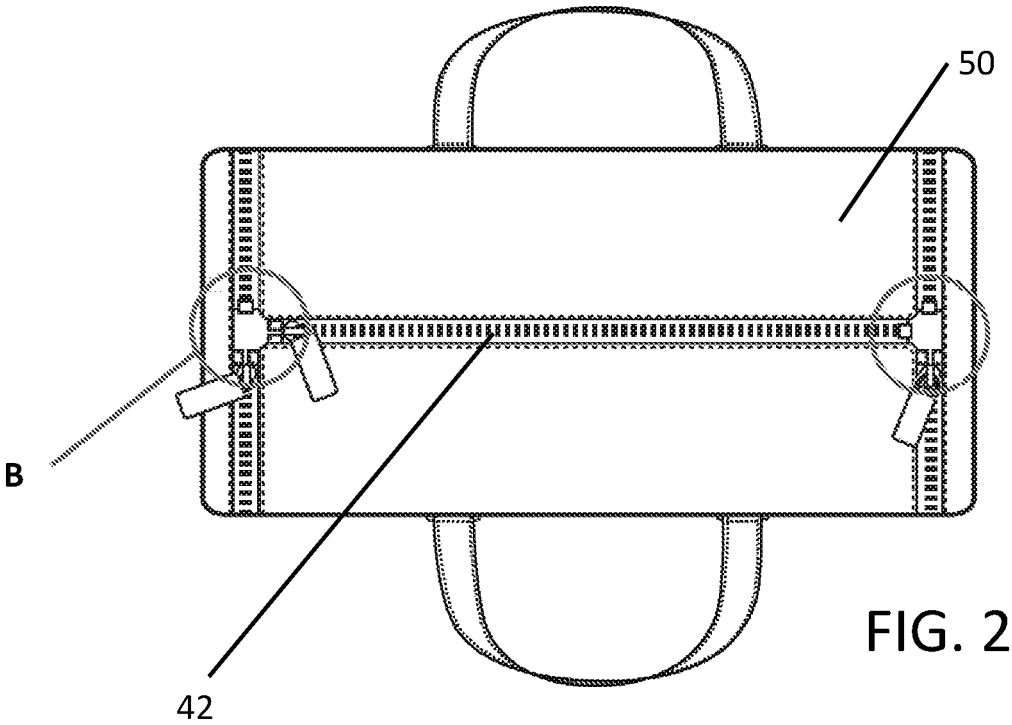
FIG. 26 is a top view of the preferred reconfigurable bag 10 shown in FIG. 1. The first pair of matable edge 42 are embodied in a separating zipper that enables the center piece 50 to lie flat when matable edge 42 are unmated. (See area "B".)
Figure 27:
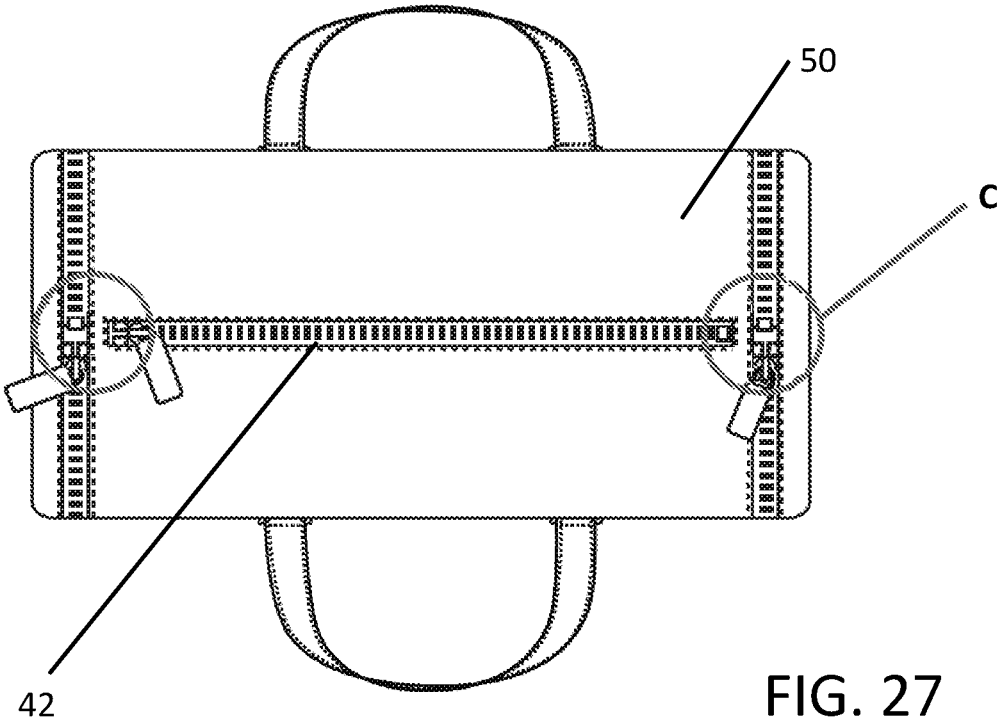
FIG. 27 is a top view of a reconfigurable bag embodiment where the center piece 50 is a tube and the first pair of matable edges 42 does not extend the full width of the center piece 50. (See area "C".)
Figure 28:
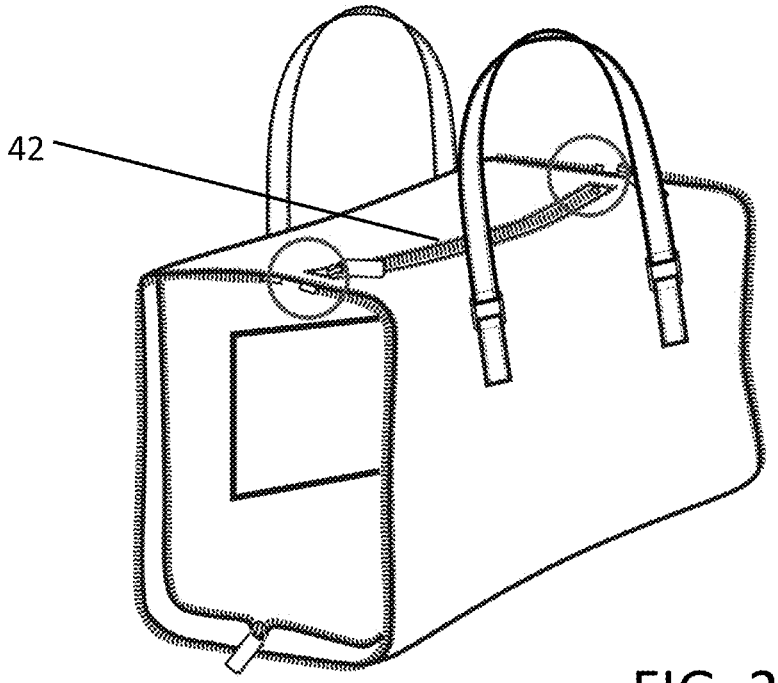
FIG. 28 is a perspective view of a reconfigurable bag 10 where the center piece 50 is a tube and does open into a quadrilateral shape when the first pair of matable edges 42 is unmated.

Another embodiment arises by employing a tube-style center piece 50 instead of a center-piece 50 that can lie flat when unmated. As shown in FIGS. 26-28, the first pair of matable edges 42 does not need go the full width of center piece 50. (See area "B".) The matable edges 42 can stop short leaving the top corners non-removably connected as shown. (See area "C".) In other words, a closed end zipper could be used as the matable edges 42 as opposed to a full-width separating zipper. Even though the center piece 50 is a tube shape, it can still be reconfigured to a lap top style bag 62 if the corners are connected by simply folding the bag along the matable edge 42. This tube-style center piece 50 can also be used for the center piece 50 in the cross-body bag embodiment 64.

Male-Female Matable Edges

Figure 29:
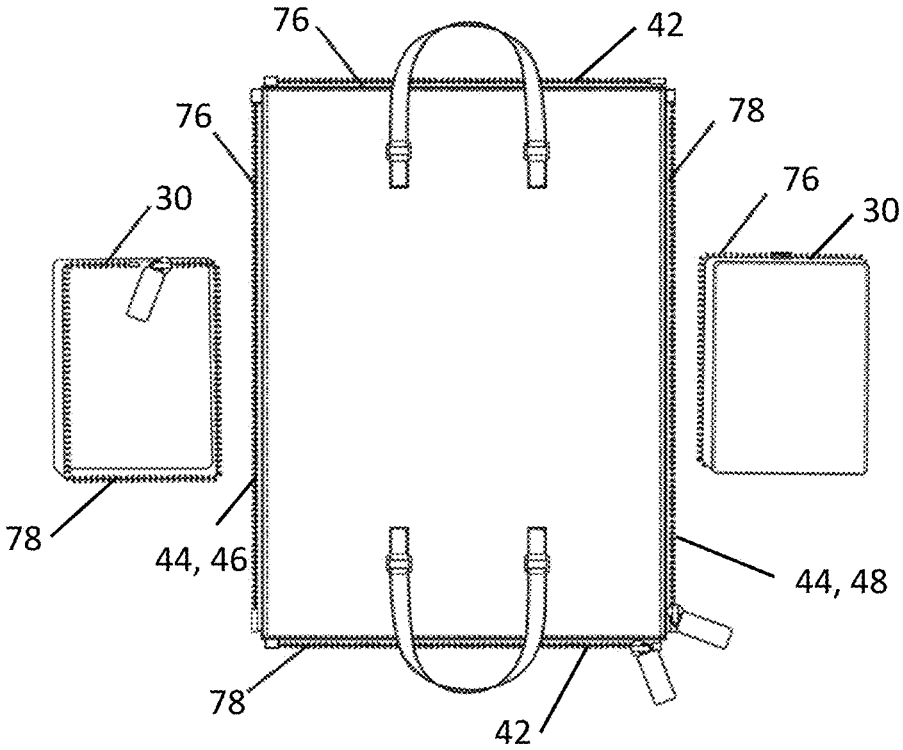
FIG. 29 is a top view of an embodiment of a center piece 50 flanked on either side by a perspective view of a pair of end pieces 20, illustrating the pair of male/female matable edges of the reconfigurable bag 10.
Figure 30:
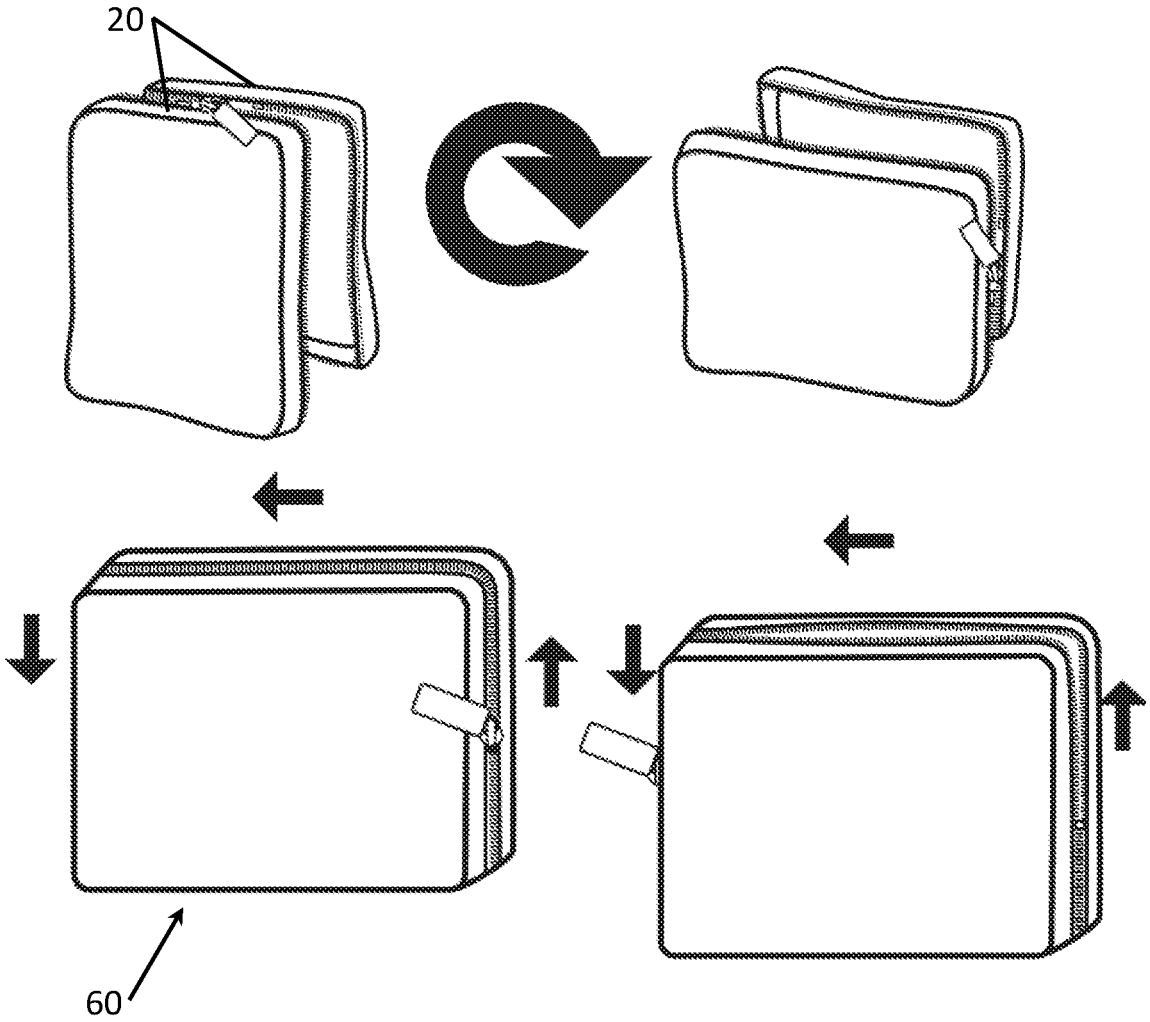
FIG. 30 illustrates that the pair of end pieces 20 can be rotated to form different bag orientations, each of which has a top portion, the top portion of each bag orientation each having a corresponding bag entrance.
Figure 31:
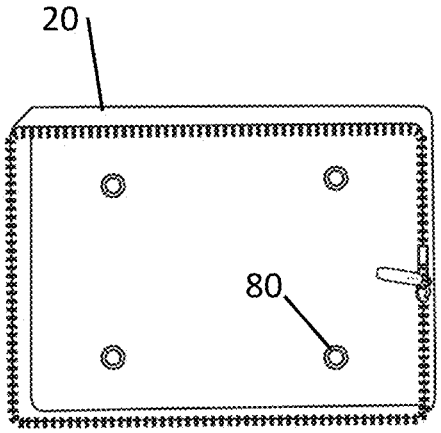
FIG. 31 is a perspective view of the interior of an end piece 20 having a plurality of snaps 80 to removably connect an interior pocket 74 (not shown).

One of the key elements to the reconfigurable bag 10 is the orientation of the male-female matable edges. FIG. 29 illustrates one embodiment for the orientation of male connectors 76 and female connectors 78 various matable edge pairs. In order for a pair of end pieces 20 to mate with each other (to form the second bag (or clutch) 60) one of the pair of end pieces must be a male connector 76 and the other must be a female connector 78. As a result, opposite edges (46, 68) of center piece 50 must also have complementary connectors (76, 78) in order to mate with both end pieces 20 to form the first handbag 40. For example, as shown in FIG. 29, if the first center piece edge 46 is a male connector 76, the second center piece edge 48 must be a female connector 78. If both sides of the center piece 50 had male connectors or both had female connectors, then the pair of end pieces 20 could only matably connect to each other or the center piece 50. If one side of the centerpiece has a male connector and the other side has a female connector, then the pair of end pieces can matably connect to each other and to the center piece 50 as shown in FIG. 29.

The connectors 76, 78 may be any type of device that can securely couple bag pieces together. Typical connectors may include zippers, snaps, buttons, magnets, hook and loop fasteners (e.g., velcro brand fasteners), grommets with laces and the like. The connectors 76, 78 may be anything that removably fastens, connects, couples, adheres, affixes or binds bag sections together.

Rotatable Interior Pockets

Figure 32:
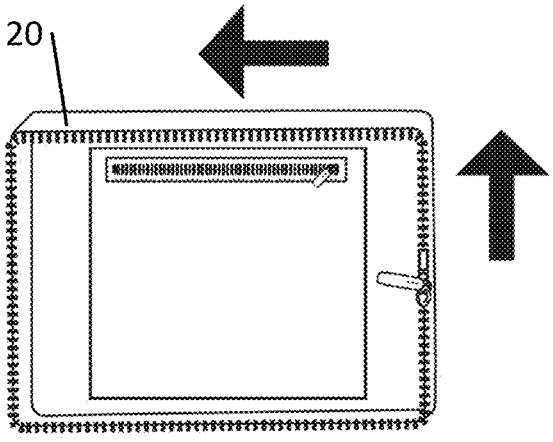
FIG. 32 is a perspective view of the interior of an end piece 20 having an interior pocket 74.
Figure 33:
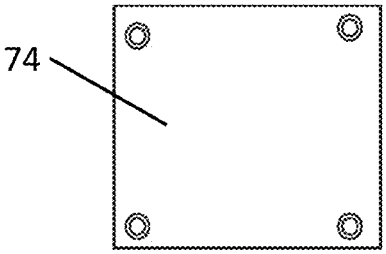
FIG. 33 is a bottom view of an interior pocket 74 having snaps.
Figure 34:
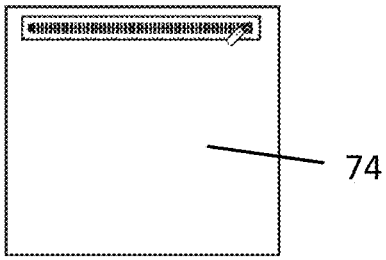
FIG. 34 is a top view of the interior pocket 74 embodiment shown in FIG. 33.
Figure 35:
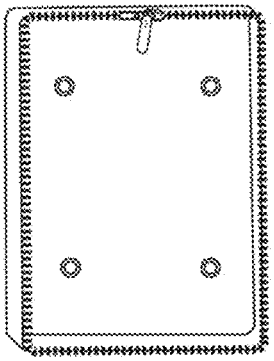
FIG. 35 is a perspective view of the end piece 20 shown in FIG. 31, rotated ninety degrees counterclockwise.
Figure 36:
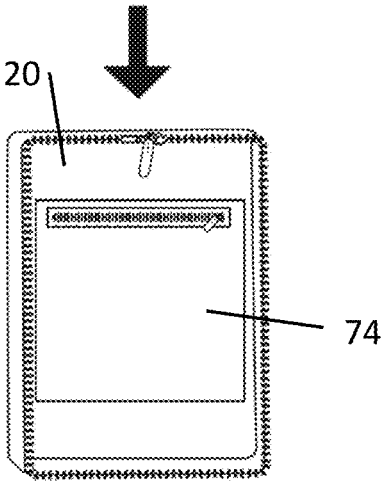
FIG. 36 is a perspective view of the end piece shown in FIG. 32, rotated ninety degrees clockwise, but the removable interior pocket 74 remains in the "up" position.
Figure 37:
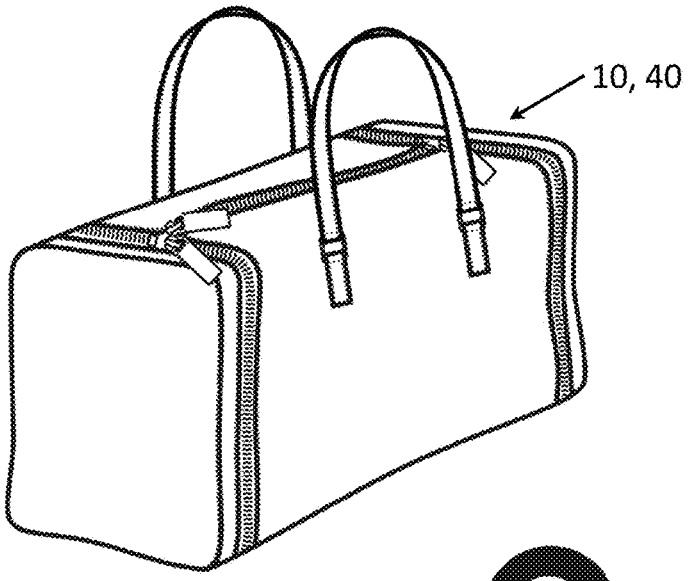
FIGS. 37-56 illustrate perspective step-by-step views of reconfiguring a bag 10 from a second handbag 60 to a laptop-style bag 62 while keeping the contents of the bag secure against falling out during the reconfiguration process.
Figure 38:
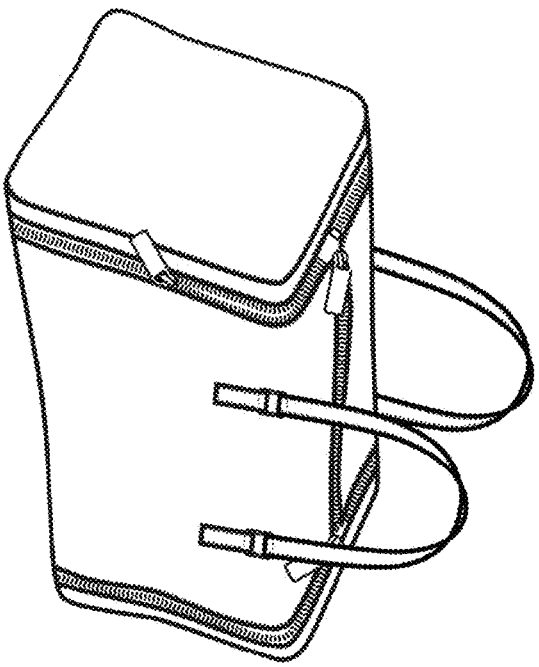
Figure 39:
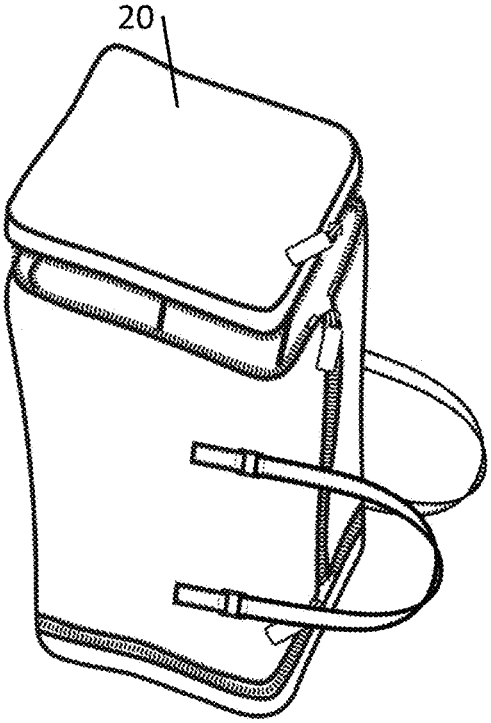
Figure 40:
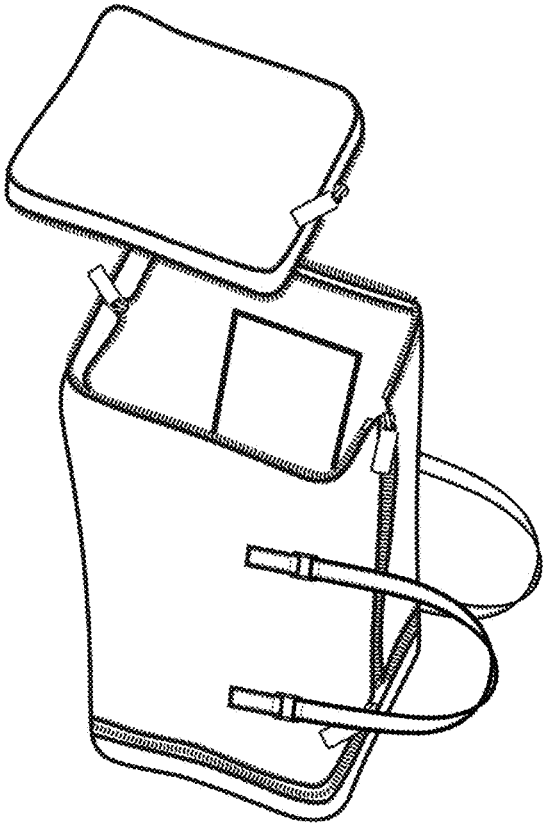
Figure 41:
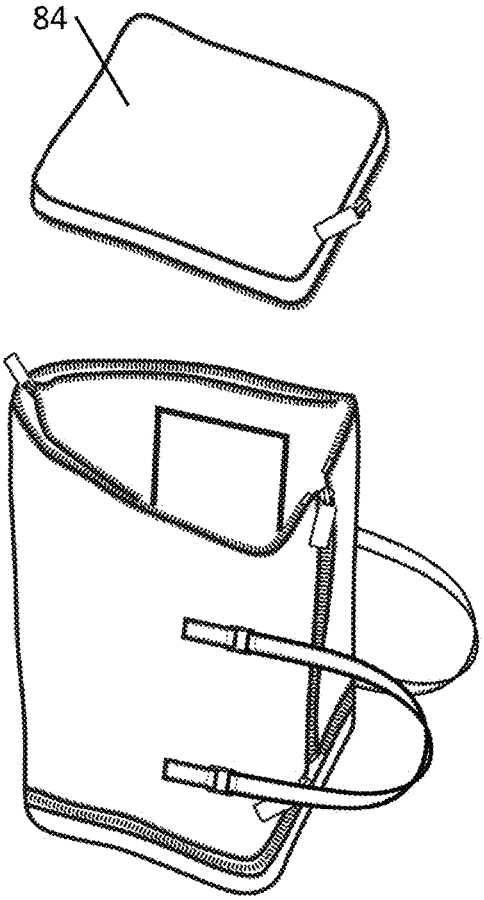
Figure 42:
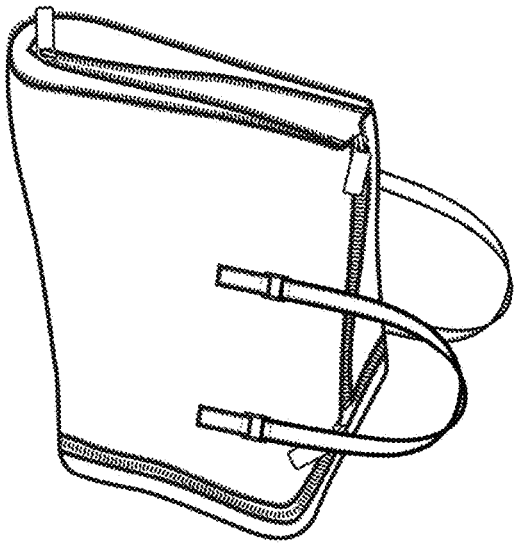

Sometimes, it is preferred to rotate the end pieces 20 ninety degrees or more when the bag 10 is reconfigured from one mode to another. See FIGS. 30-36, with FIG. 33 showing the back side of interior pocket 74 and FIG. 34 showing the front side of interior pocket 74. When this happens, an interior pocket 74 would ordinarily rotate, too, leaving the interior pocket 74 sideways or upside down. The preferred way to remedy this issue is to matably connect an interior pocket 74 to an end piece 20. That way, the interior pocket 74 can be removed and reconnected in the "up" position. (Compare FIG. 32 with FIG. 36.) The interior pocket 74 can be mated by snaps as shown in FIGS. 33 and 35 or by other suitable removable connectors known in the art.

Reconfiguring Bag without Having to Empty it or Having Items Fall Out

Figure 43:
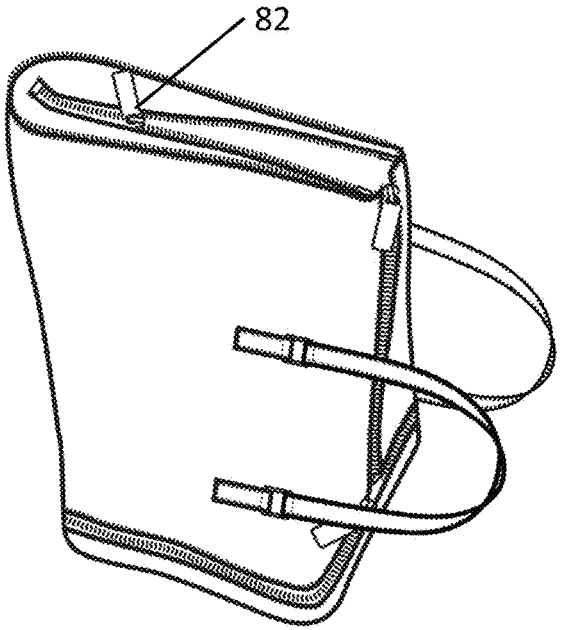
Figure 44:
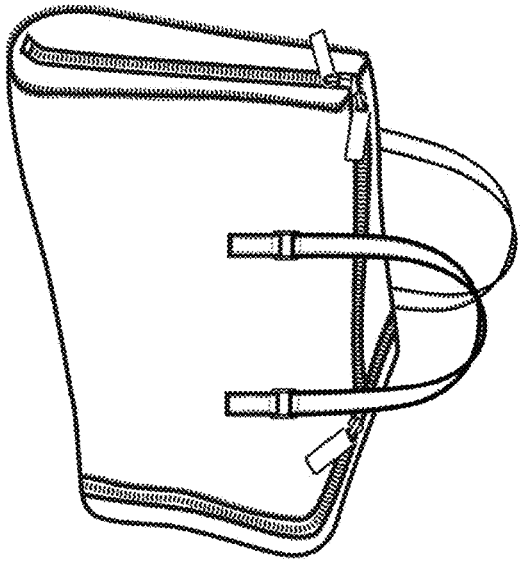
Figure 46:
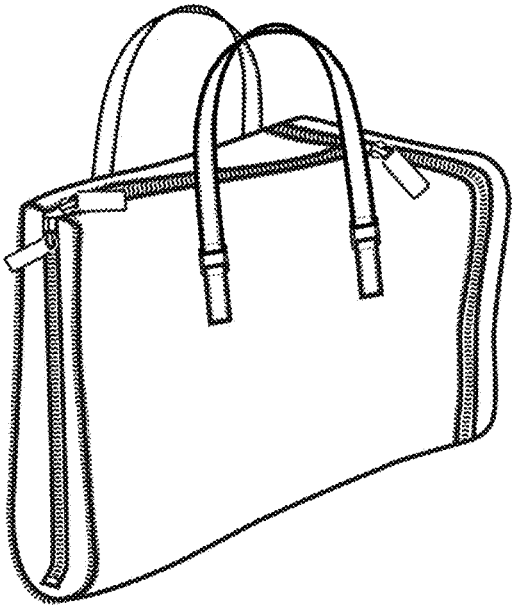
Figure 45:
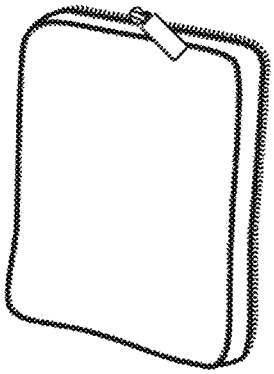
Figure 47:
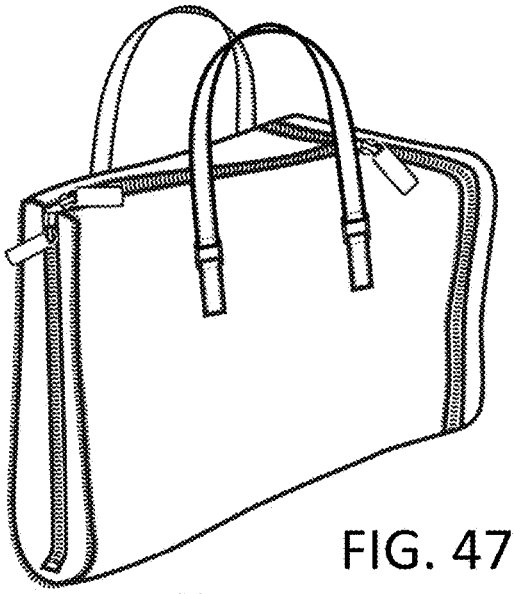
Figure 48:
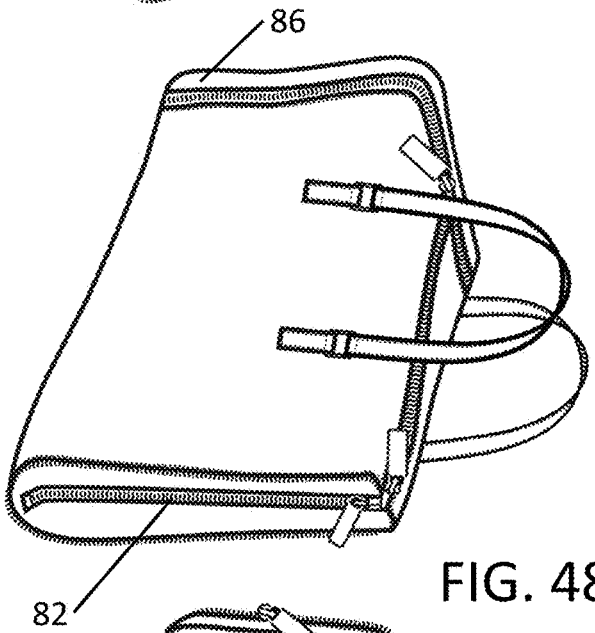
Figure 49:
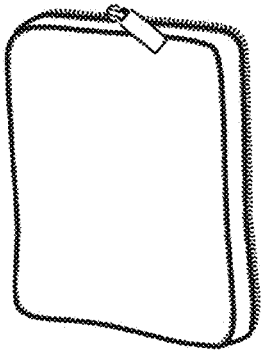
Figure 50:
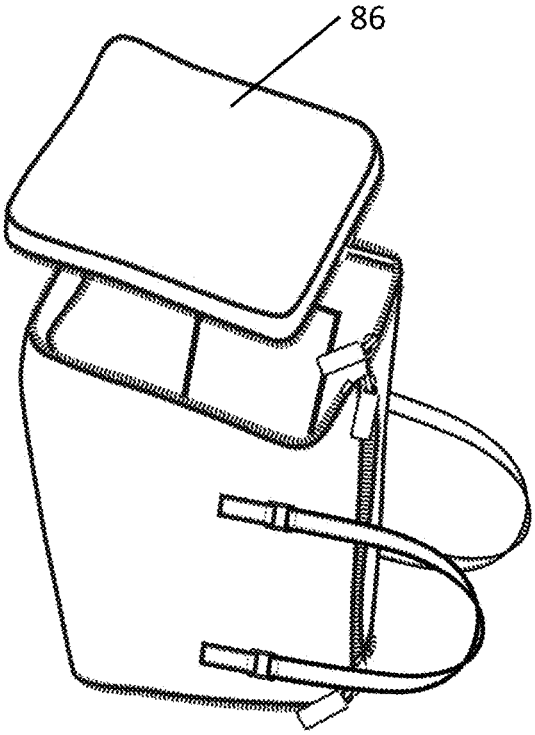
Figure 51:
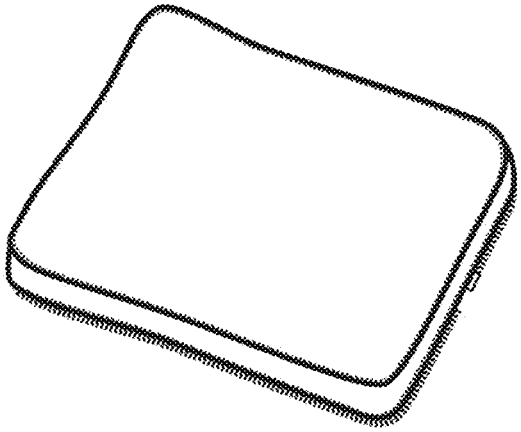
Figure 52:
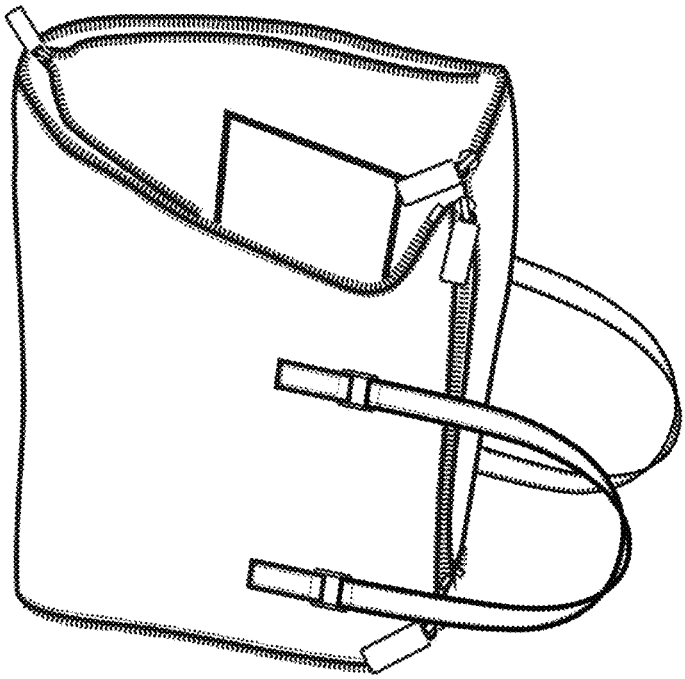
Figure 53:
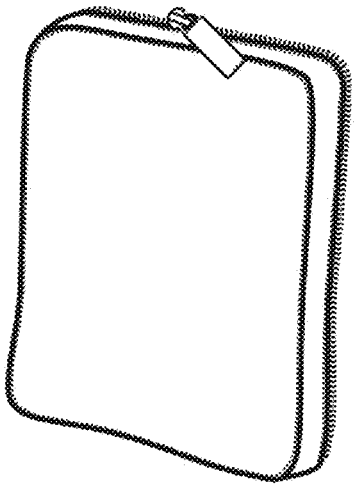
Figure 54:
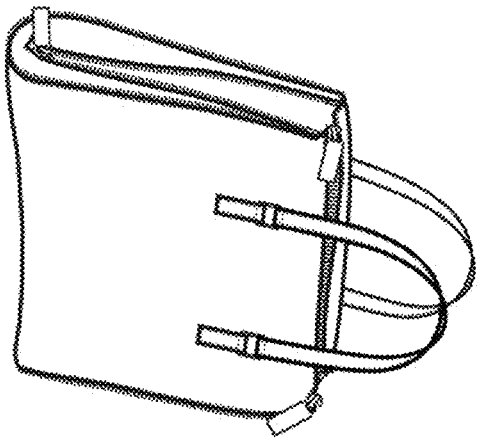
Figure 55:
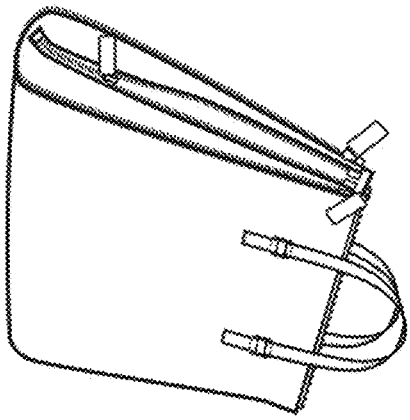
Figure 56:
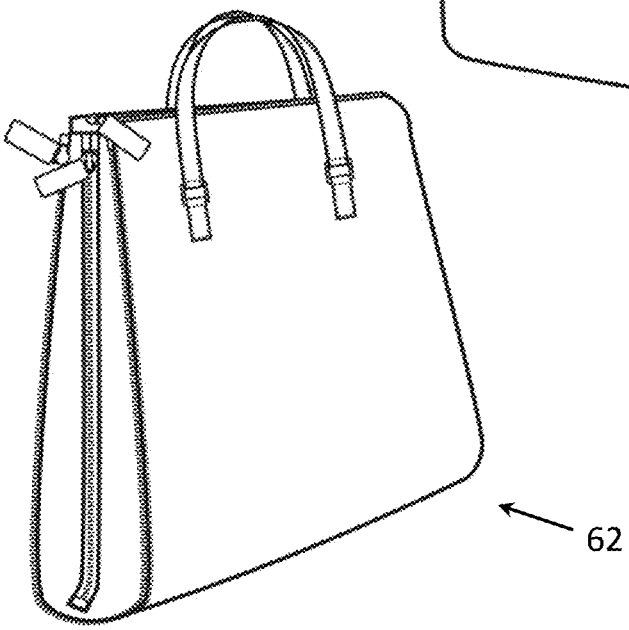

Attempting to reconfigure a bag in a public place can be troublesome. Typically, one would have to take out the contents of the bag first; else items would fall out as the bag is reconfigured. As shown in FIGS. 37-56, the preferred reconfigurable bag 10 can be reconfigured from a bag having a center piece 50 with a pair of end pieces 20 mated on either side to a laptop bag 72 embodiment—all without items falling out of the bag. As shown in FIGS. 43, 48 and 50, closing zipper 82 after removing the first end piece 84 seals the end of the bag so that when the second end piece 86 is removed, zipper 82 keeps the contents of the bag inside the bag.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the photos or herein are given as an example of possible components and not as a limitation.

The invention claimed is:

1. A reconfigurable bag comprising, a center piece comprising a flexible material, two transverse sides, and two longitudinal sides, a first mateable edge located on a left longitudinal side of the center piece, the first matable edge comprising a first end located at one of the transverse sides;

a second mateable edge located on a right longitudinal side of the center piece, the second matable edge comprising a second end located at one of the transverse sides;

a left end piece comprising a left end panel having a bottom, a left end gusset, and a left end mateable edge, a first side of the left end gusset connected to the perimeter of the end panel, and a second side of the left end gusset connected to the left end mateable edge, wherein the left end mateable edge starts/ends at a distance above the bottom and wherein the left end mateable edge is configured to mate with the center piece;

a right end piece comprising a right end panel having a bottom, a right end gusset, and a right end mateable edge, a first side of the right end gusset connected to the perimeter of the end panel, and a second side of the right end gusset connected to the right end mateable edge, wherein the right end mateable edge starts/ends at a distance above the bottom and wherein the right end mateable edge is configured to mate with the center piece, wherein when the left end piece and the right end piece are matably connected to the center piece a first bag is formed having an opening between the two transverse sides, and wherein when the left end mateable edge and the right end mateable edge are matably connected a second bag having a handles at the top is formed.

2. The reconfigurable bag of claim 1 wherein the matable edges comprise zippers.

3. The reconfigurable bag of claim 1, where only one handle is used on one of the pair of end pieces.

4. The reconfigurable bag of claim 1, the center piece further comprising a frame for a zipper connected to the two transverse sides, the frame having an extension flap that is not connected to the center piece.

5. The reconfigurable bag of claim 4 further comprising a ring connected to one of the end pieces, wherein the ring can be inserted through a hole in the extension flap to connect the center piece to the end piece.

6. A center piece for a reconfigurable bag, the reconfigurable bag comprising a center piece, a left end piece and a right end piece, the center piece further comprising a first matable edge and a second mateable edge for mating with a left end mateable edge on the left end piece and a right end matable edge on the right end piece respectively to form a first bag, the center piece comprising, a flexible material comprising two transverse sides and two longitudinal sides, the first mateable edge located on a left longitudinal side of the center piece, the second mateable edge located on a right longitudinal side of the center piece, a left extension flap connected to the center piece, the left extension flap oriented parallel to the left longitudinal side; the left extension flap bifurcated along an axis parallel to the transverse sides to form a top left mateable extension flap and a bottom left mateable extension flap, the bottom left and top left mateable extension flaps configured to mate with each other, and a right extension flap connected to the center piece, the right extension flap oriented parallel to the right longitudinal side; the right extension flap bifurcated along an axis parallel to the transverse sides to form a top right mateable extension flap and a bottom right mateable extension flap, the bottom right and top right mateable extension flaps configured to mate with each other, wherein a second bag is formed when the bottom left and top left mateable extension flaps are mated with each other and the bottom right and top right mateable extension flaps are mated with each other.

7. The center piece of claim 6, wherein the mateable edges comprise zippers, buttons, magnets, hook and loop fasteners, grommets with laces, or snaps.

8. The center piece of claim 6, wherein the extension flaps comprise zippers buttons, magnets, hook and loop fasteners, grommets with laces, or snaps.

9. The center piece of claim 6 further comprising a pair of edges located respectively on each one of the transverse sides, the pair of edges mateable with each other.

10. The center piece of claim 9, the pair of edges comprising a closed zipper, a separating zipper, a non-separating zipper or snaps.

11. The center piece of claim 9, wherein the top left mateable extension flap and the bottom left mateable extension flap comprise a zipper or snaps, and the top right extension flap and the bottom right extension flap comprise a zipper or snaps.

12. A pair of end pieces for a reconfigurable bag having a center piece and a pair of end pieces that matably connect to the center piece to form a first bag, the pair of end pieces comprising, a left end piece comprising a left end panel having a bottom, a left end gusset, and a left end mateable edge, a first side of the left end gusset connected to the perimeter of the end panel, and a second side of the left end gusset connected to the left end mateable edge, wherein the left end mateable edge starts/ends at a distance above the bottom and wherein the left end mateable edge is configured to mate with the center piece;

a right end piece comprising a right end panel having a bottom, a right end gusset, and a right end mateable edge, a first side of the right end gusset connected to the perimeter of the end panel, and a second side of the right end gusset connected to the right end mateable edge, wherein the right end mateable edge starts/ends at a distance above the bottom and wherein the right end mateable edge is configured to mate with the center piece; and wherein left end mateable edge is configured to mate with the right end mateable edge to form a second bag.

13. The pair of end pieces of claim 12 wherein the matable edges comprise zippers.

14. The pair of end pieces of claim 12, wherein at least one of the pair of end pieces comprises a handle connected to a top side of either the right or the left end piece.

* * * * *